US011906263B2

(12) United States Patent
Underwood et al.

(10) Patent No.: US 11,906,263 B2
(45) Date of Patent: Feb. 20, 2024

(54) FOLDING STOCK ASSEMBLIES

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 96 days.

(21) Appl. No.: 17/391,728

(22) Filed: Aug. 2, 2021

(65) Prior Publication Data

US 2022/0034626 A1 Feb. 3, 2022

Related U.S. Application Data

(60) Provisional application No. 63/059,217, filed on Jul. 31, 2020.

(51) Int. Cl.
*F41C 23/04* (2006.01)
*F41A 35/06* (2006.01)

(52) U.S. Cl.
CPC ..... *F41C 23/04* (2013.01); *F41A 35/06* (2013.01)

(58) Field of Classification Search
CPC ..... F41C 23/14; F41C 23/04; F41A 11/04; F41A 35/06
USPC ..... 42/75.03, 73, 71.01
See application file for complete search history.

(56) References Cited

U.S. PATENT DOCUMENTS

| | | | | |
|---|---|---|---|---|
| 3,442,042 | A | 5/1969 | Gilbert | |
| 4,513,523 | A | 4/1985 | Gal | |
| 4,640,036 | A | 2/1987 | Gal | |
| 4,735,007 | A | 4/1988 | Gal | |
| 4,766,800 | A | 8/1988 | Miller et al. | |
| 4,788,785 | A | 12/1988 | White | |
| 5,778,588 | A | 7/1998 | Allen, III et al. | |
| 7,162,823 | B2 | 1/2007 | Schoppman et al. | |
| 7,827,721 | B2 | 11/2010 | Griffin | |
| 7,966,761 | B1 | 6/2011 | Kuczynko et al. | |
| 8,245,429 | B2 | 8/2012 | Kuczynko et al. | |
| 8,429,844 | B2 | 4/2013 | Dextraze et al. | |
| 8,448,366 | B2 | 5/2013 | Faifer | |
| 8,631,601 | B2 * | 1/2014 | Langevin | F41C 23/04 42/73 |
| 8,656,623 | B1 | 2/2014 | Chvala | |
| 8,667,883 | B1 | 3/2014 | Larson et al. | |
| 8,769,855 | B2 * | 7/2014 | Law | F41C 23/14 42/73 |
| 8,820,212 | B2 | 9/2014 | Rostocil | |
| 8,915,005 | B2 | 12/2014 | Grimshaw et al. | |
| 8,991,088 | B1 | 3/2015 | Young | |
| 9,228,786 | B2 | 1/2016 | Sullivan et al. | |
| 9,228,795 | B1 | 1/2016 | Kielsmeier et al. | |
| 9,410,764 | B2 | 8/2016 | Jarboe | |
| 9,488,434 | B2 | 11/2016 | Kielsmeier et al. | |
| D773,593 | S | 12/2016 | Hopkins et al. | |
| 9,546,845 | B2 | 1/2017 | Mather | |

(Continued)

*Primary Examiner* — Michael D David

(57) ABSTRACT

An ambidextrous folding stock assembly for a firearm includes a forward hinge fitting attached to the firearm, a central assembly disposed on a rear side of the forward hinge fitting, and a rear hinge fitting disposed on a rear side of the central assembly. The central assembly includes at least one hinge body, an actuation portion including a lower portion disposed below the at least one hinge body, and at least one latch portion disposed below the at least one hinge body.

21 Claims, 26 Drawing Sheets

(56) References Cited

U.S. PATENT DOCUMENTS

| | | | | |
|---|---|---|---|---|
| 9,664,478 | B2 | 5/2017 | Robinson et al. | |
| 9,829,272 | B2 | 11/2017 | Brown | |
| 10,054,393 | B2 | 8/2018 | Kedairy | |
| 10,113,832 | B2 | 10/2018 | Law | |
| 10,156,421 | B2 | 12/2018 | Smith et al. | |
| 10,371,474 | B2 | 8/2019 | Young | |
| 10,443,972 | B1 | 10/2019 | Haugland | |
| 10,704,848 | B1 | 7/2020 | Zeider et al. | |
| 10,900,741 | B2 | 1/2021 | Kielsmeier et al. | |
| 11,143,470 | B1 * | 10/2021 | Roth | F41A 3/66 |
| 11,609,066 | B1 * | 3/2023 | Newby | F41C 23/04 |
| 2006/0242880 | A1 * | 11/2006 | Griffin | F41C 23/04 42/73 |
| 2009/0288324 | A1 | 11/2009 | Peterson et al. | |
| 2011/0131857 | A1 | 6/2011 | Kuczynko et al. | |
| 2012/0137562 | A1 | 6/2012 | Langevin et al. | |
| 2013/0212920 | A1 * | 8/2013 | Law | F41C 23/14 42/75.03 |
| 2014/0026745 | A1 | 1/2014 | Lee | |
| 2014/0075815 | A1 | 3/2014 | Jarboe | |
| 2014/0331539 | A1 | 11/2014 | Malik | |
| 2014/0360074 | A1 | 12/2014 | Jarboe | |
| 2015/0013203 | A1 | 1/2015 | Lopiccolo | |
| 2016/0202016 | A1 | 7/2016 | Mather et al. | |
| 2017/0153084 | A1 | 6/2017 | Tarazi | |
| 2017/0356712 | A1 | 12/2017 | Johnson | |
| 2018/0195822 | A1 | 7/2018 | Jonsson | |
| 2020/0200505 | A1 | 6/2020 | Brown, Jr. | |
| 2021/0215451 | A1 | 7/2021 | Ding et al. | |
| 2021/0222993 | A1 | 7/2021 | Morenz et al. | |
| 2022/0034625 | A1 * | 2/2022 | Underwood | F41A 35/06 |

* cited by examiner

FOLDING STOCK ASSEMBLIES

CROSS REFERENCE TO RELATED APPLICATIONS

This application is related to and claims priority benefit from U.S. Provisional Application No. 63/059,217 ("the '217 application"), filed on Jul. 31, 2020. This application is also related to U.S. Application No. 63/059,212 ("the '212 application"), filed on Jul. 31, 2020. The '217 application and the '212 application are each hereby incorporated in their entirety by this reference.

FIELD OF THE INVENTION

The field of the invention relates to firearms, particularly folding stock assemblies in firearms.

BACKGROUND

Many modern firearms are designed with a collapsible or folding shoulder stock which can make the firearm more compact for storage, carrying, and/or concealment. For example, law enforcement or security details may need firearms with greater capabilities than typical handguns but may also require inconspicuous storage and carrying of such firearms. Conventional concealable firearms include either (i) a collapsing stock, which does not sufficiently reduce the size of the firearm or (ii) a folding stock capable of folding to either the left side or the right side of the firearm.

To increase versatility and options for concealment while improving ergonomics of firearms with a folding stock, it may be desirable to design new ambidextrous folding stock assemblies that include the capability of folding to either the left or the right side of the firearm.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an ambidextrous folding stock assembly for a firearm comprises: a forward hinge fitting attached to the firearm; a central assembly disposed on a rear side of the forward hinge fitting; and a rear hinge fitting disposed on a rear side of the central assembly, wherein: the central assembly comprises: at least one hinge body; an actuation portion comprising a lower portion disposed below the at least one hinge body; and at least one latch portion disposed below the at least one hinge body.

According to certain embodiments of the present invention, a firearm comprises: an ambidextrous folding stock assembly comprising: a forward hinge fitting configured to attach to a firearm receiver; a hinge body pivotably attached to a rear side of the forward hinge fitting; a rear hinge fitting attached to a rear side of the hinge body; an actuation portion movable relative to the hinge body; and at least one latch portion.

DETAILED DESCRIPTION

Figure 1:
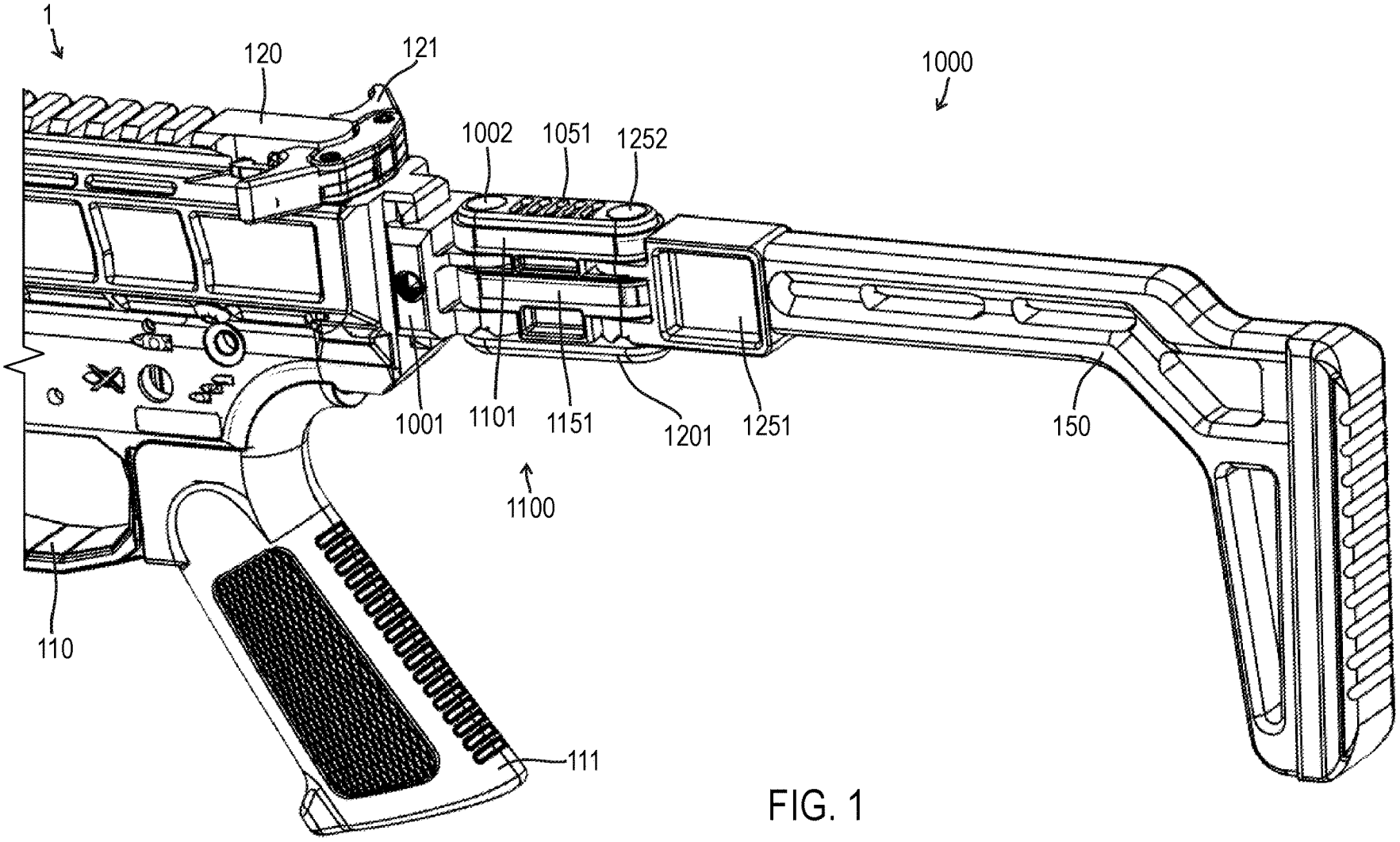
FIG. 1 is a left perspective view of a firearm with a folding stock assembly according to certain embodiments of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-22 show components of the AR-15 variant (civilian) or M16/M4 (military) firearm platform (i.e., AR-15 style firearms), the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge. Further, the term "stock" encompasses firearm stocks, firearm braces, firearm buttstocks, firearm arm braces, and/or other devices designed to improve ergonomics and/or facilitate interfaces between a rear portion of a firearm and an operator's body.

In some embodiments, including illustrative examples shown in FIGS. 1-4C, a firearm 1 may include a lower receiver 110, a grip 111, an upper receiver 120, a charging handle 121, a folding stock assembly 1000, and a stock 150. The folding stock assembly 1000 may be fully ambidextrous such that the stock 150 can move based on the folding stock assembly 1000 moving between (i) the rearward configuration shown in FIGS. 1 and 2, (ii) the left side folded configuration shown in FIGS. 3A-3C, (iii) the right side folded configuration shown in FIGS. 4A-4C, and an infinite number of configurations between these illustrated configurations (i.e., various partially folded configurations).

As shown in FIGS. 1-4C, the folding stock assembly 1000 may include a forward hinge fitting 1001, a forward hinge pin 1002, an actuation portion 1051, an upper hinge body 1101, a lower hinge body 1151, a latch portion 1201, a rear hinge fitting 1251, a rear hinge pin 1252, and a fold lock mechanism 1100.

Figure 2:
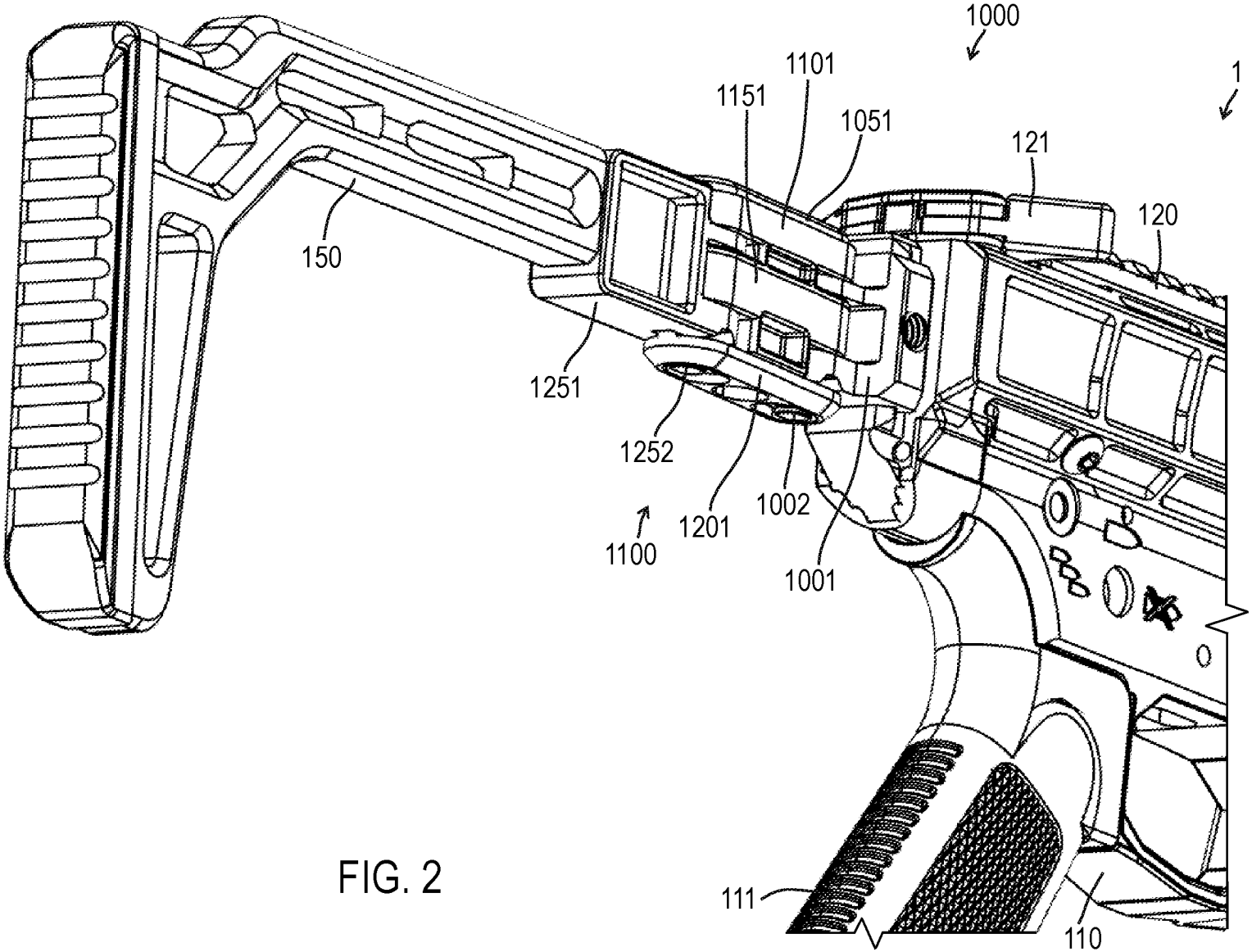
FIG. 2 is a right perspective view of the firearm with folding stock assembly of FIG. 1.
Figure 9:
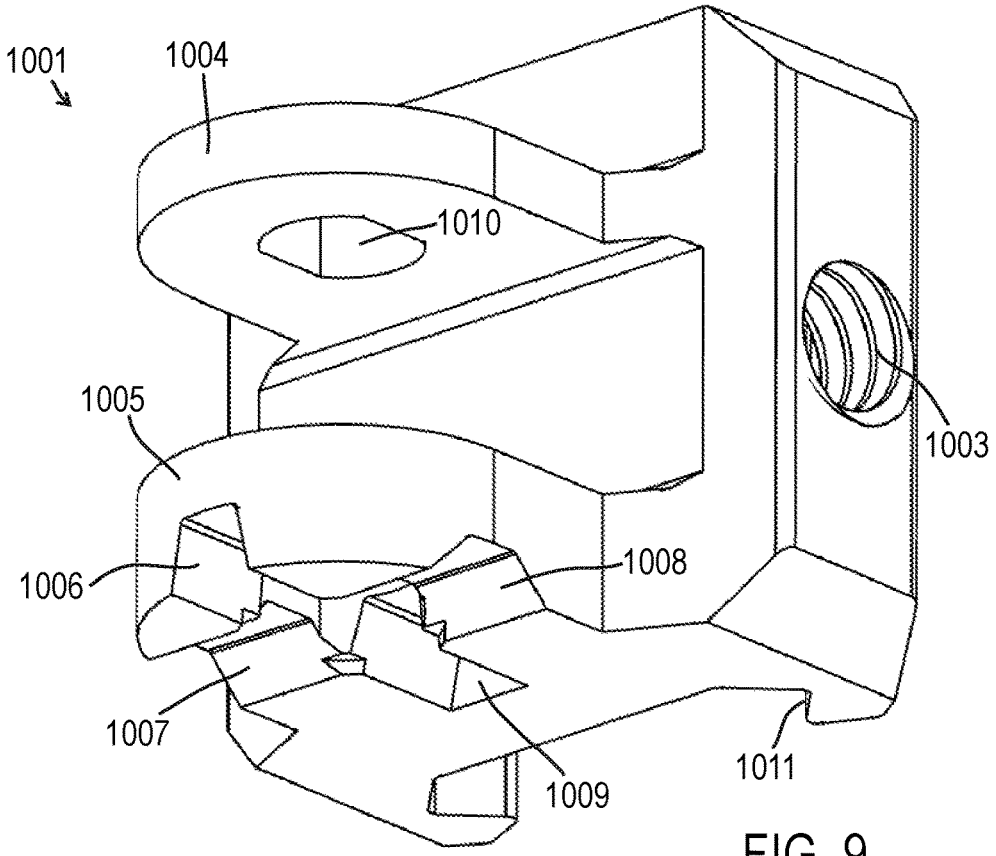
FIG. 9 is a rear perspective view of a forward hinge fitting of the folding stock assembly of FIG. 1.

The forward hinge fitting 1001, as shown in FIGS. 1-2, may be removably attached to other portions of the firearm 1 (e.g., to the lower receiver 110). However, in other embodiments, the forward hinge fitting 1001 is a permanent or integral component of the firearm 1. The forward hinge fitting 1001 may include an attachment portion 1011. In some cases, the attachment portion 1011 is a picatinny rail or weaver rail attachment with a fastener hole 1003 for adjusting or securing attachment. As shown in FIG. 9, on the rear side, the forward hinge fitting 1001 may include a pivot hole 1010, an upper lug 1004, and a lower lug 1005. In some cases, the pivot hole 1010 extends through both the upper lug 1004 and the lower lug 1005. The lower lug 1005 may include at least one notch for engaging the latch portion 1201. For example, the lower lug 1005 may include a rear notch 1006, a first lateral notch 1007, a second lateral notch 1008, and a forward notch 1009. The notches 1006-1009 may have different geometric properties that affect the function of the folding stock assembly 1000. For example, the lateral notches 1007, 1008 may have a more gradual taper or curve (compared to the rear notch 1006 and/or the forward notch 1009). The notches 1006-1009 are illustrated with straight tapers but one or more of the notches 1006-1009 may include a curved (non-linear) profile. In other embodiments, the notches 1006-1009 are all identical with the same geometric properties.

Figure 10:
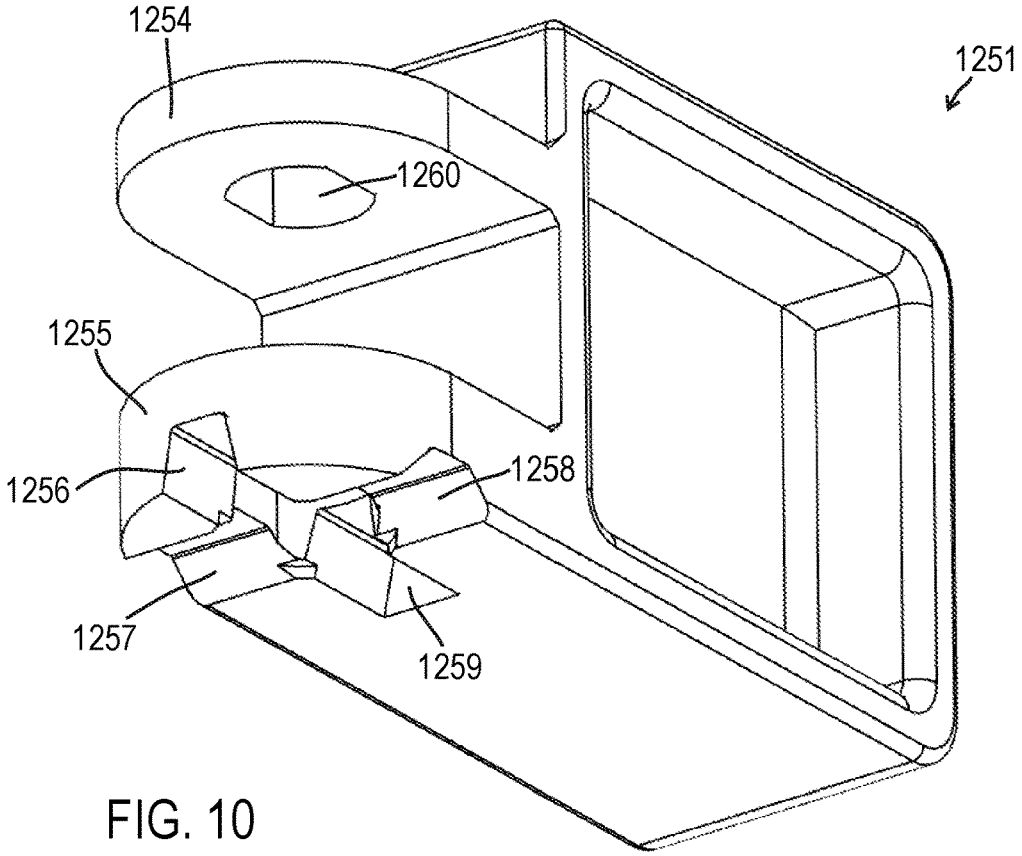
FIG. 10 is a forward perspective view of a rear hinge fitting of the folding stock assembly of FIG. 1.

The rear hinge fitting 1251, as shown in FIGS. 1-2, may be attached to other portions of the firearm 1 (e.g., to the stock 150). In some embodiments, the rear hinge fitting 1251 is removably attached to the stock 150. As shown in FIG. 10, on the rear side, the rear hinge fitting 1251 may include a pivot hole 1260, an upper lug 1254, and a lower lug 1255. In some cases, the pivot hole 1260 extends through both the upper lug 1254 and the lower lug 1255. The lower lug 1255 may include at least one notch for engaging the latch portion 1201. For example, the lower lug 1255 may include a forward notch 1256, a first lateral notch 1257, a second lateral notch 1258, and a rear notch 1259. The notches 1256-1259 may have different geometric properties that affect the function of the folding stock assembly 1000. For example, the lateral notches 1257, 1258 may have a more gradual taper or curve (compared to the forward notch 1256 and the rear notch 1259). The notches 1256-1259 are illustrated with straight tapers but one or more of the notches 1256-1259 may include a curved (non-linear) profile. In other embodiments, the notches 1256-1259 are all identical with the same geometric properties.

In some embodiments, where the lateral notches 1007, 1008, 1257, 1258 each include less steep or more gradual tapers/curves compared to the forward/rear notches 1006, 1009, 1256, 1259 (as shown in FIGS. 9 and 10), the function of the folding stock assembly 1000 can be tailored to different situations. For example, in some cases, the steeper profile of the forward/rear notches 1006, 1009, 1256, 1259 dictate that the folding stock assembly 1000 cannot be moved out of the rearward configuration (see FIGS. 1 and 2) without fully depressing the actuation portion 1051. In other words, the folding stock assembly 1000 may be designed minimize or eliminate the chance of accidentally moving the stock 150 out of the rearward configuration. Conversely, the more gradual profile of the lateral notches 1007, 1008, 1257, 1258 may be configured such that the folding stock assembly 1000 can be moved out of the left side folded configuration and/or the right side folded configuration (see FIGS. 3A-4C) with partial depressing of the actuation portion 1051 (or, in some cases, without any interaction with the actuation portion 1051). In other words, the folding stock assembly 1000 may be designed such that an operator can quickly pivot the stock 150 from the left side folded configuration and/or the right side folded configuration to the rearward configuration.

Figure 7:
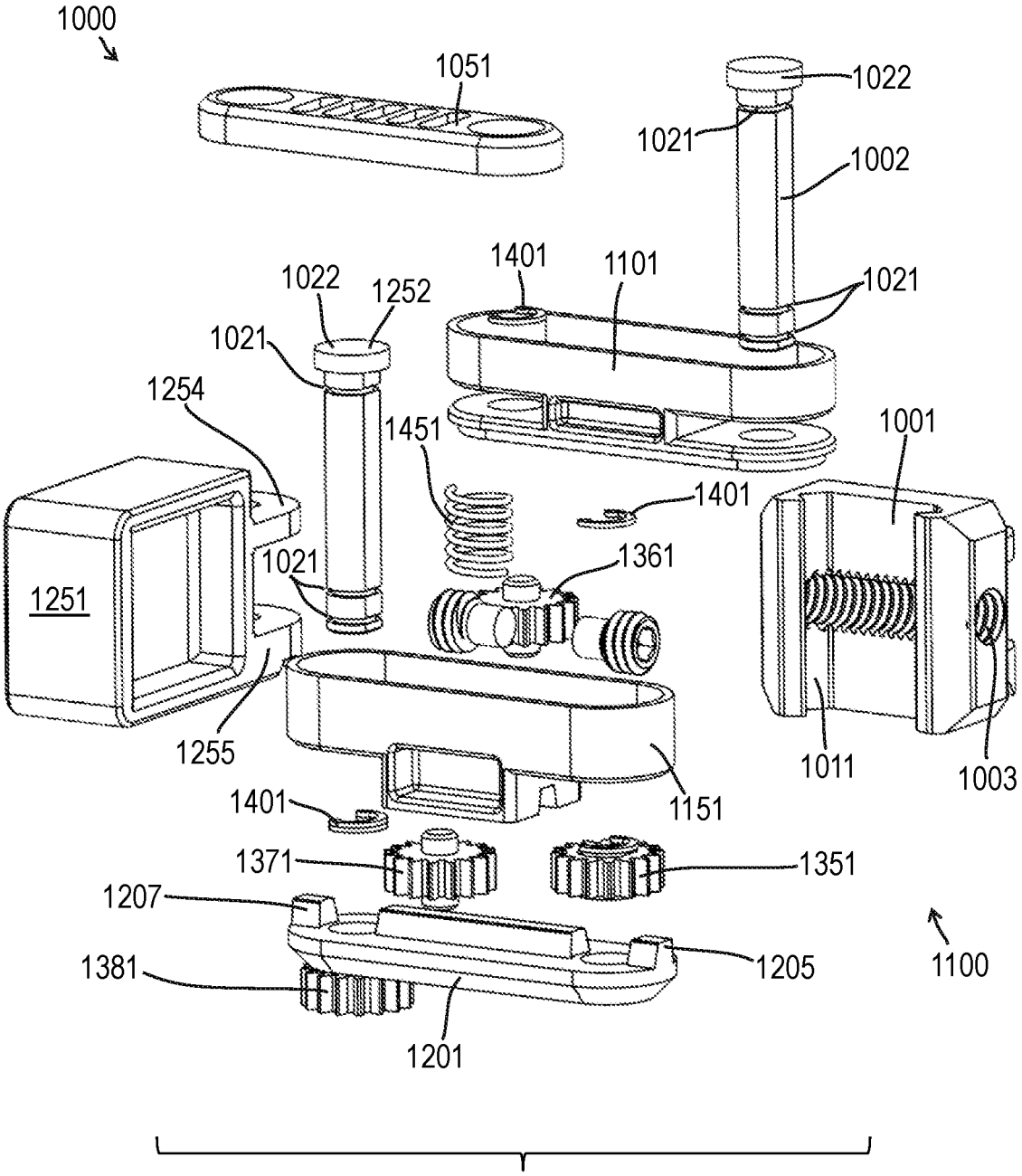
FIG. 7 is a right perspective exploded view of the folding stock assembly of FIG. 1.

As shown in FIGS. 1-5B, in between the forward hinge fitting 1001 and the rear hinge fitting 1251, the folding stock assembly 1000 may have a central assembly that includes the actuation portion 1051 at the upper portion of the upper hinge body 1101, the lower hinge body 1151 arranged on the lower side of the upper hinge body 1101, and a latch portion 1201 located at the bottom of the lower hinge body 1151. The central assembly is connected to the forward hinge fitting 1001 by the forward hinge pin 1002, which extends (from top to bottom) through (i) hole 1052 of the actuation portion 1051, (ii) hole 1102 of the upper hinge body 1101, (iii) pivot hole 1010 of the upper lug 1004 of the forward hinge fitting 1001, (iv) hole 1152 of the lower hinge body 1151, (v) pivot hole 1010 of the lower lug 1005 of the forward hinge fitting 1001, and (vi) hole 1202 of the latch portion 1201. Similarly, the central assembly is connected to the rear hinge fitting 1251 by the rear hinge pin 1252, which extends (from top to bottom) through (i) hole 1054 of the actuation portion 1051, (ii) hole 1104 of the upper hinge body 1101, (iii) pivot hole 1260 of the upper lug 1254 of the rear hinge fitting 1251, (iv) hole 1154 of the lower hinge body 1151, (v) pivot hole 1260 of the lower lug 1255 of the rear hinge fitting 1251, and (vi) hole 1204 of the latch portion 1201. As shown in FIG. 7, each hinge pin 1002, 1252 may include at least one groove 1021 for securing a retaining clip 1401 where each retaining clip 1401 secures the axial position of the respective hinge pin 1002, 1252 relative to one or more other components.

Figure 11A:
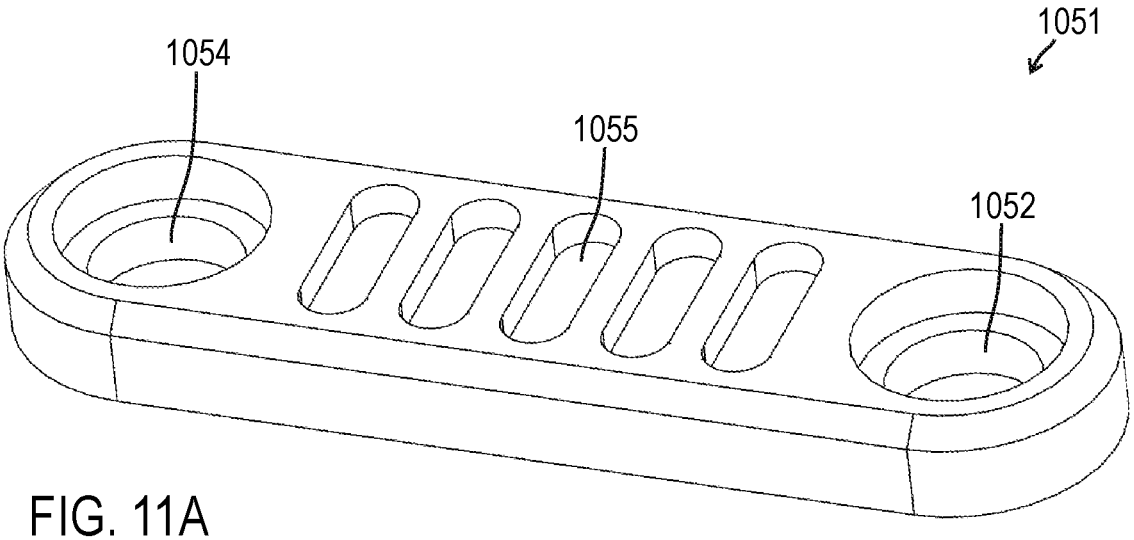
FIG. 11A is an upper perspective view of an actuation portion of the folding stock assembly of FIG. 1.
Figure 11B:
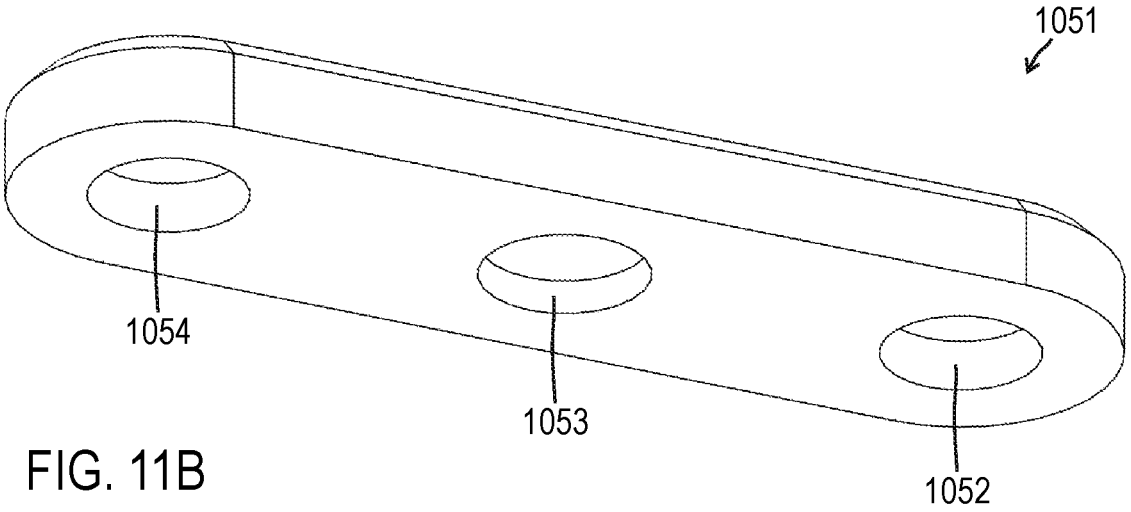
FIG. 11B is a lower perspective view of the actuation portion of FIG. 11A.
Figure 12A:
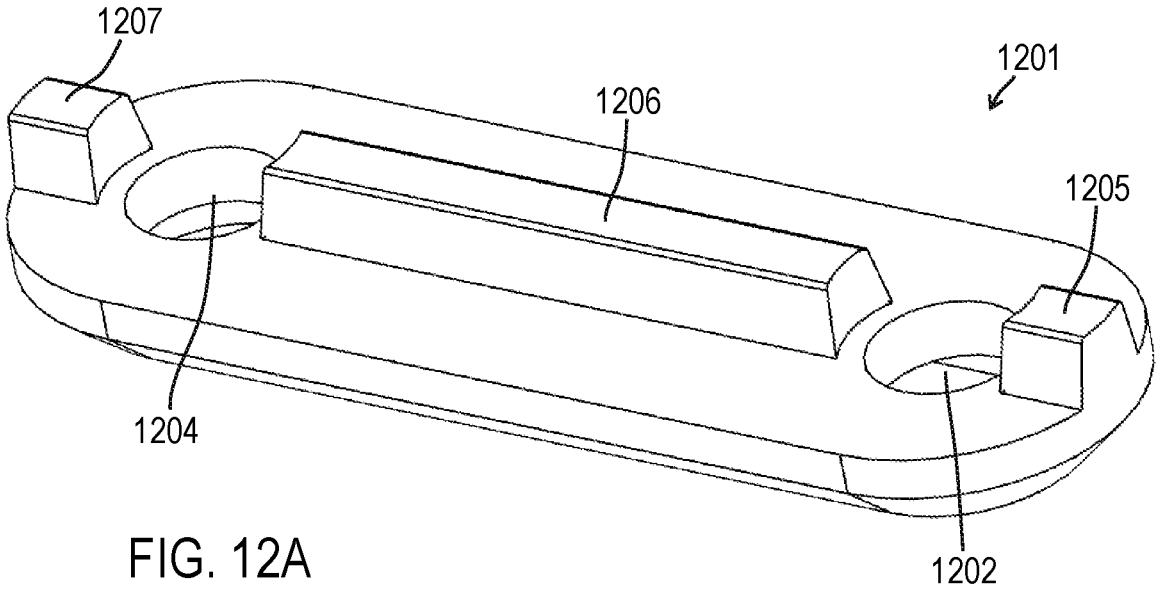
FIG. 12A is an upper perspective view of a latch portion of the folding stock assembly of FIG. 1.
Figure 12B:
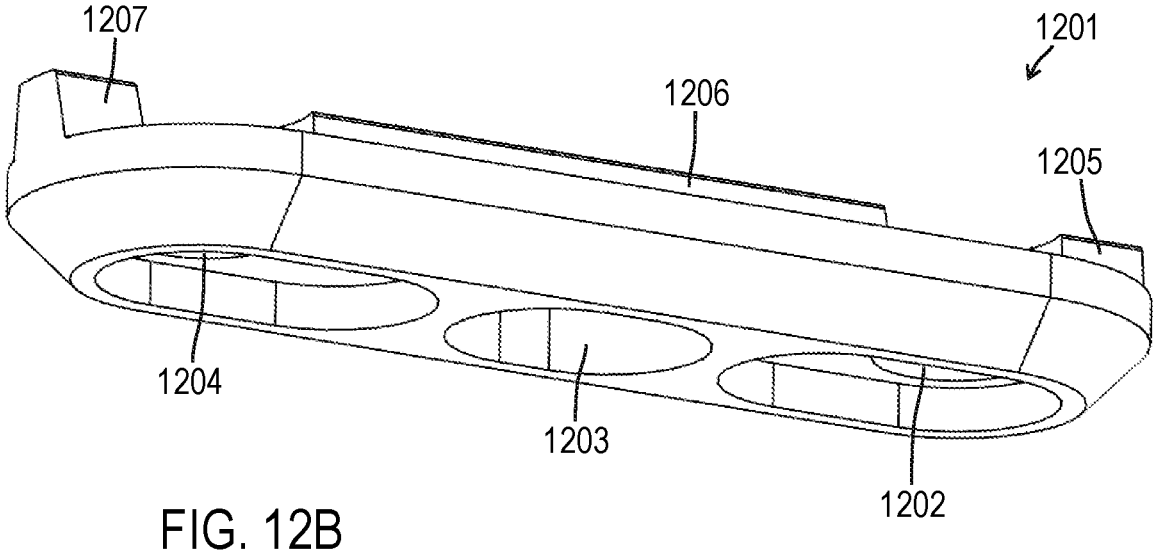
FIG. 12B is a lower perspective view of the latch portion of FIG. 12A.
Figure 13A:
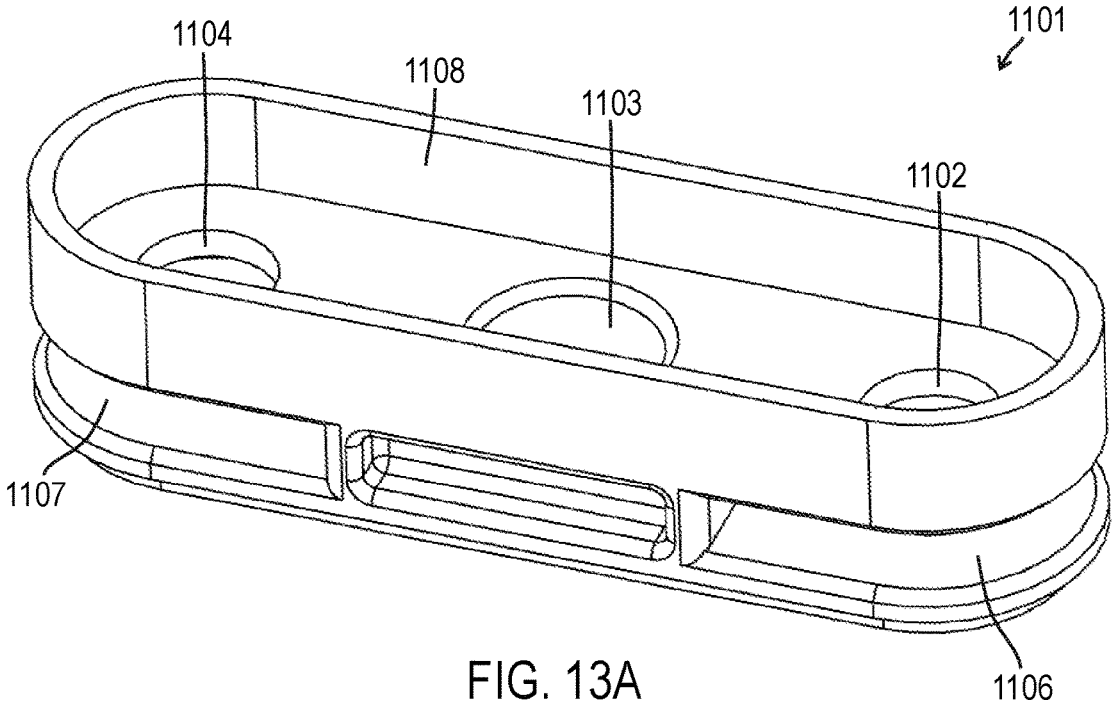
FIG. 13A is an upper perspective view of an upper hinge body of the folding stock assembly of FIG. 1.
Figure 13B:
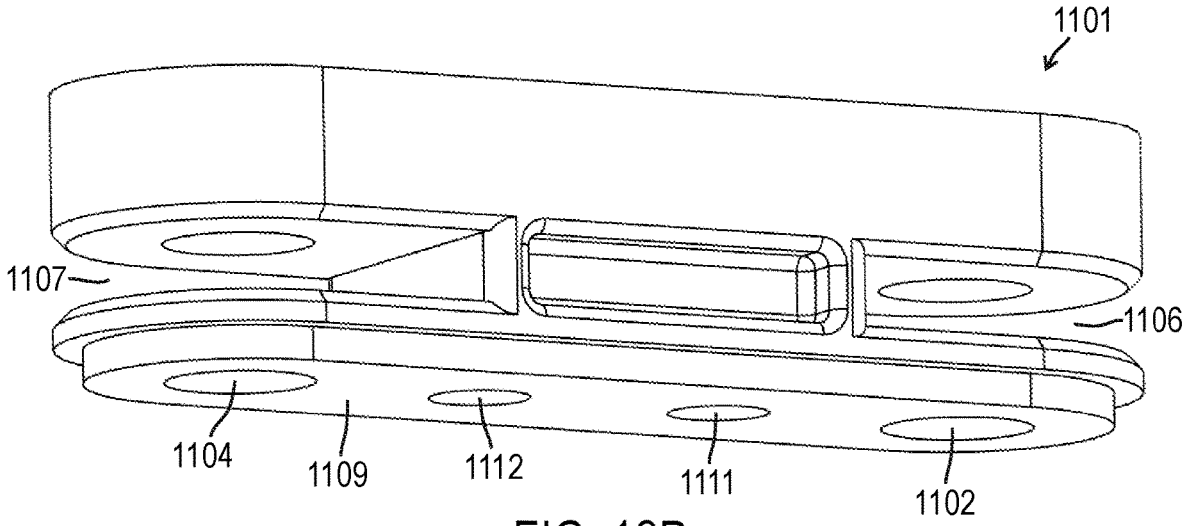
FIG. 13B is a lower perspective view of the upper hinge body of FIG. 13A.
Figure 14A:
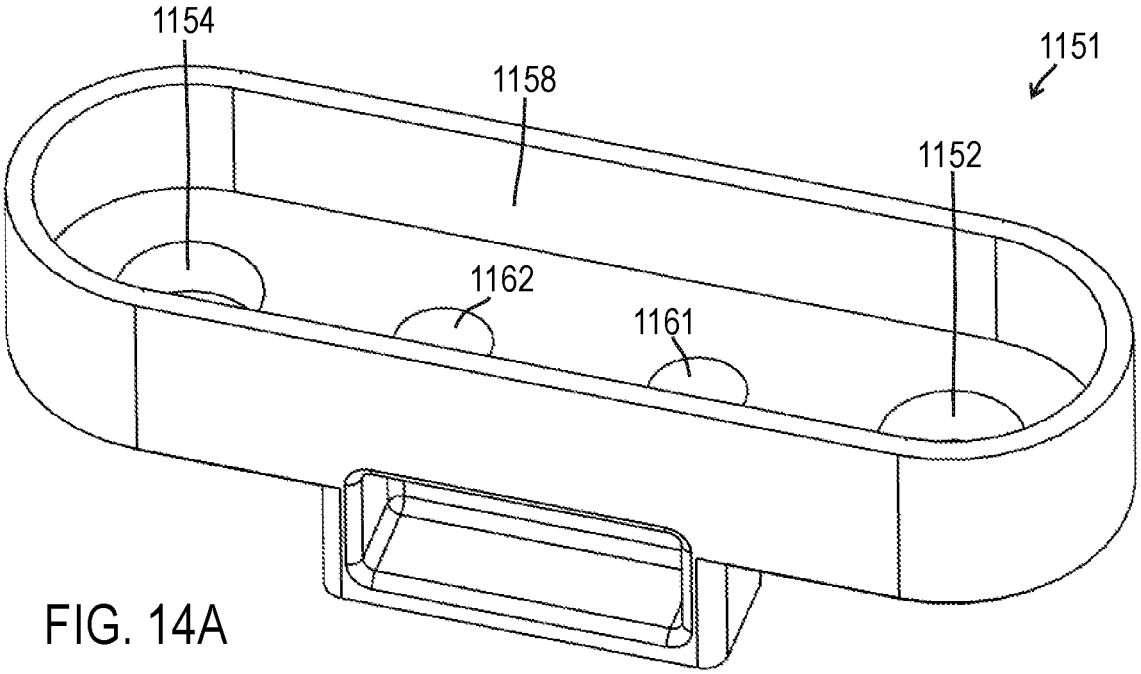
FIG. 14A is an upper perspective view of a lower hinge body of the folding stock assembly of FIG. 1.
Figure 14B:
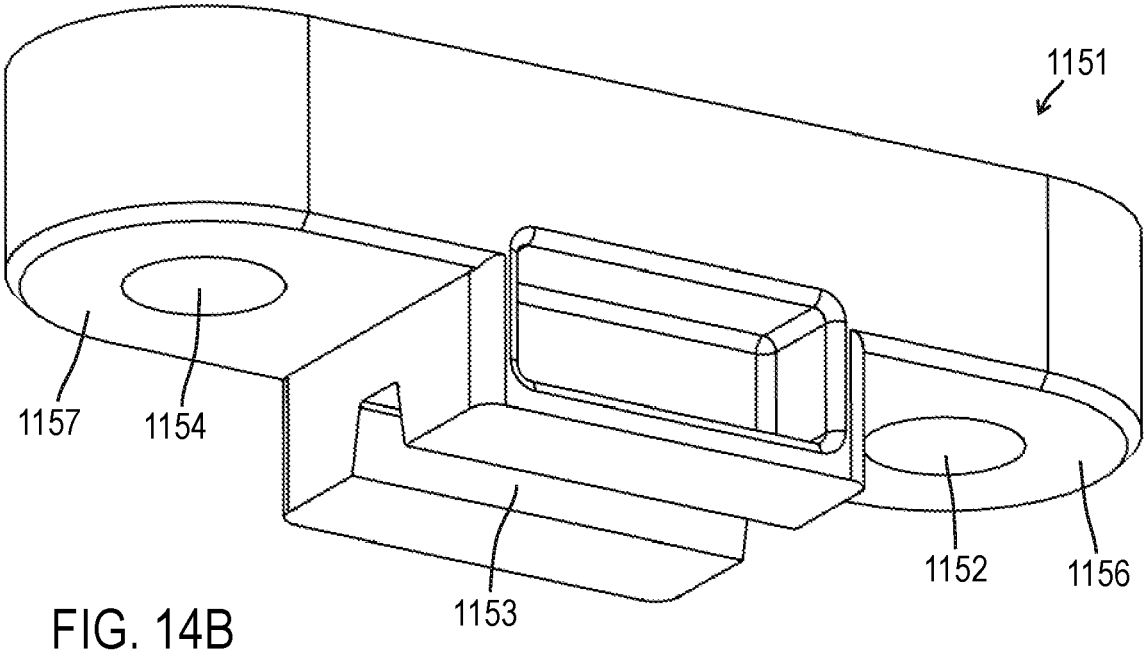
FIG. 14B is a lower perspective view of the lower hinge body of FIG. 14A.
Figure 15:
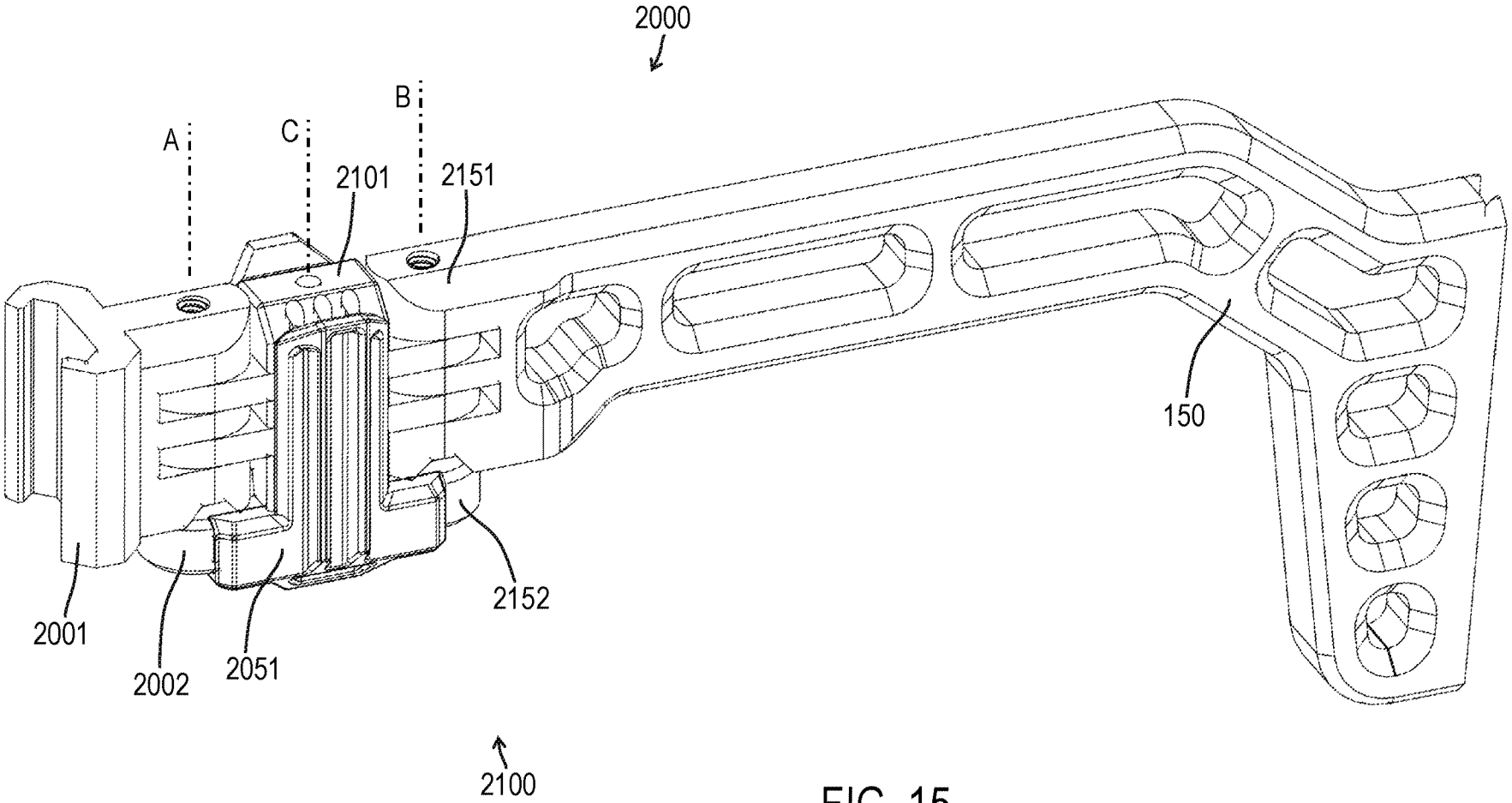
FIG. 15 is a left perspective view of a folding stock assembly according to certain embodiments of the present invention.
Figure 16:
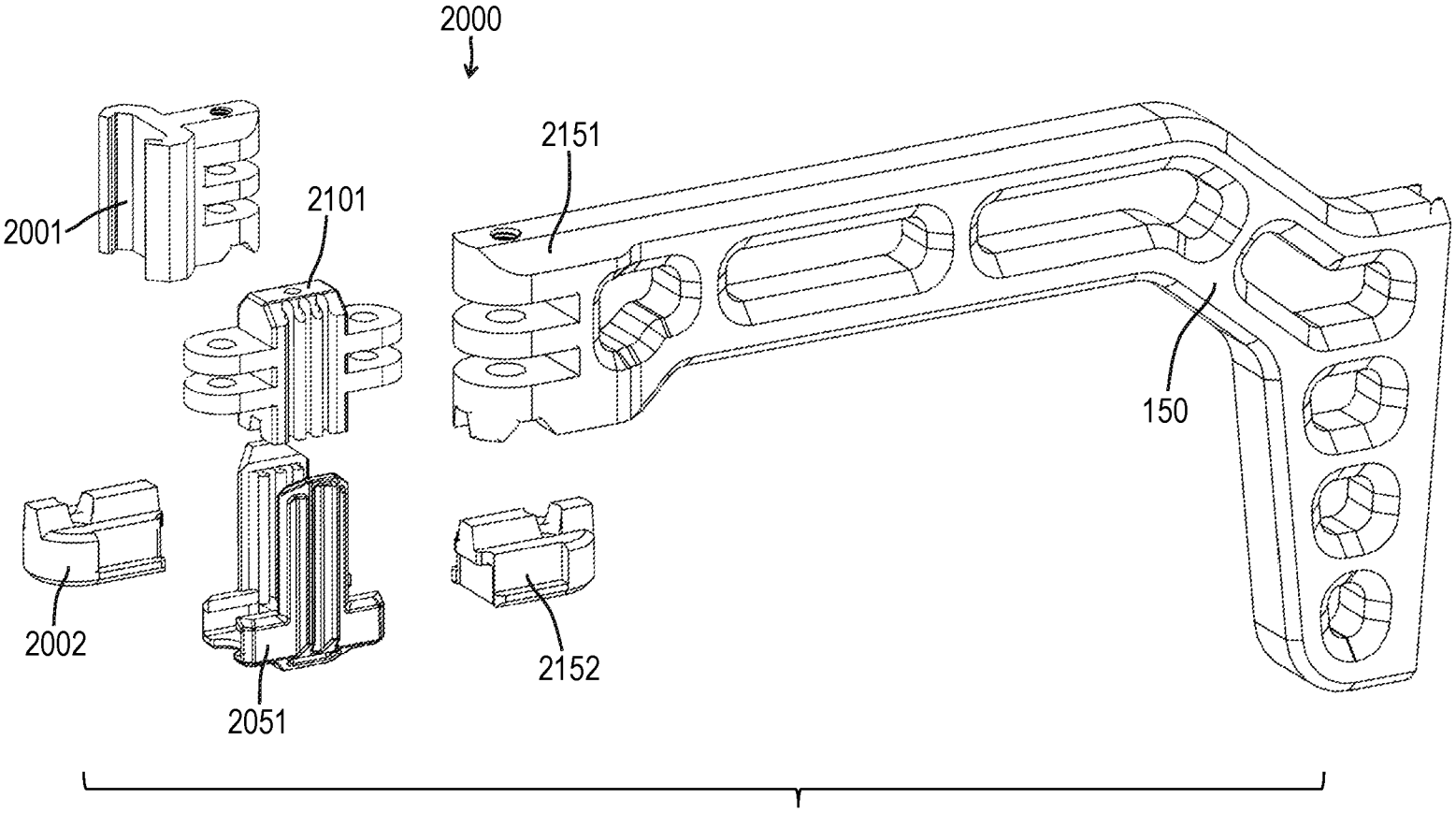
FIG. 16 is a left perspective exploded view of the folding stock assembly of FIG. 15.

As shown in FIGS. 13A and 13B, the upper hinge body 1101 may include a forward hole 1102, a rear hole 1104, a cavity 1108, a recess 1103, a forward slot 1106, a rear slot 1107, and a lower protrusion 1109. The forward slot 1106 may approximately correspond to the size of the upper lug 1004 of the forward hinge fitting 1001 such that the upper lug 1004 is disposed within the slot 1106. The rear slot 1107 may approximately correspond to the size of the upper lug 1254 of the rear hinge fitting 1251 such that the upper lug 1254 is disposed within the slot 1107. As described above, the forward hole 1102 may be aligned (i.e., coaxial) with the forward hinge pin 1002 and the rear hole 1104 may be aligned (i.e., coaxial) with the rear hinge pin 1252. In some embodiments, at least a portion of the actuation portion 1051 is disposed within the cavity 1108 of the upper hinge body 1101. The position of the actuation portion 1051 relative to the upper hinge body 1101 may be defined by a spring 1451 located within recess 1103 of the upper hinge body 1101 (see FIGS. 7 and 13A). The upper end of the spring 1451 may fit within recess 1053 of the actuation portion 1051 (see FIG. 11B). As shown in FIG. 11A, the holes 1052, 1054 of the actuation portion 1051 may include a counterbore such that the top of the head 1022 of each of the hinge pins 1002, 1252 is approximately flush with the upper surface of the actuation portion 1051. In addition, upward pressure imparted from the spring 1451 to the actuation portion 1051 is transferred through each head 1022 into the hinge pins 1002, 1252.

The lower hinge body 1151 (see FIGS. 14A and 14B) may include a forward hole 1152, a rear hole 1154, a cavity 1158, a forward lower surface 1156, a rear lower surface 1157, and a notch 1153. The forward lower surface 1156 may be configured to be located approximately adjacent to the lower lug 1005 of the forward hinge fitting 1001. Similarly, the rear lower surface 1157 may be configured to be located approximately adjacent to the lower lug 1255 of the rear hinge fitting 1251. As described above, the forward hole 1152 may be aligned (i.e., coaxial) with the forward hinge pin 1002 and the rear hole 1154 may be aligned (i.e., coaxial) with the rear hinge pin 1252. In some embodiments, the lower hinge body 1151 is disposed below the upper hinge body 1101 such that at least a portion of the lower protrusion 1109 is located within the cavity 1158 of the lower hinge body 1151. As described in greater detail below, the notch 1153 may engage central protrusion 1206 of the latch portion 1201 in some conditions (i.e., the retracted configuration).

In addition to the rotational movement that occurs between the various configurations illustrated in FIGS. 1-4C, the folding stock assembly 1000 may include a fold lock mechanism 1100 that allows limited movement in at least one more direction to constrain and/or control the rotational movement. In some embodiments, the fold lock mechanism 1100 allows vertical movement between at least one dynamic component and at least one static component. The at least one dynamic component may include the actuation portion 1051, the hinge pins 1002, 1252, and the latch portion 1201. The at least one static component may include the upper hinge body 1101, the lower hinge body 1151, the forward hinge fitting 1001, and the rear hinge fitting 1251.

Figure 8A:
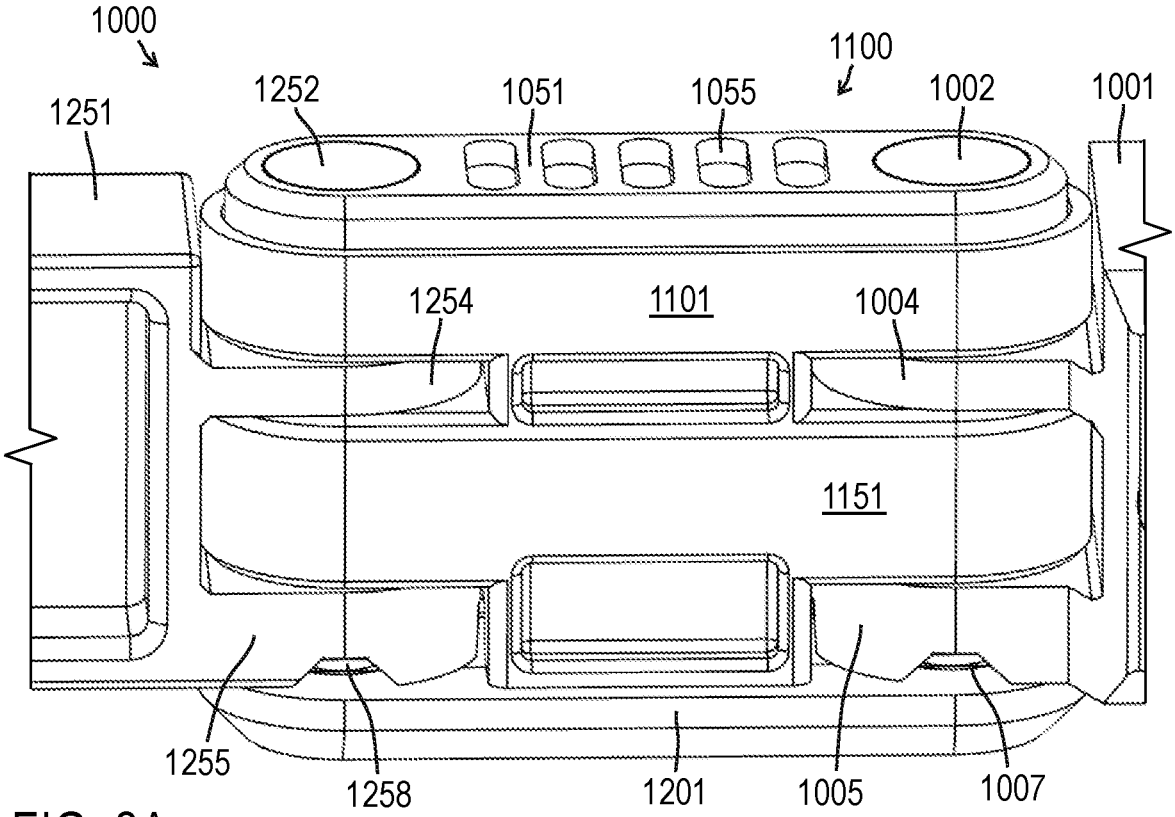
FIG. 8A is a right partial perspective view of the folding stock assembly of FIG. 1 with a fold lock mechanism in a retracted configuration.
Figure 8B:
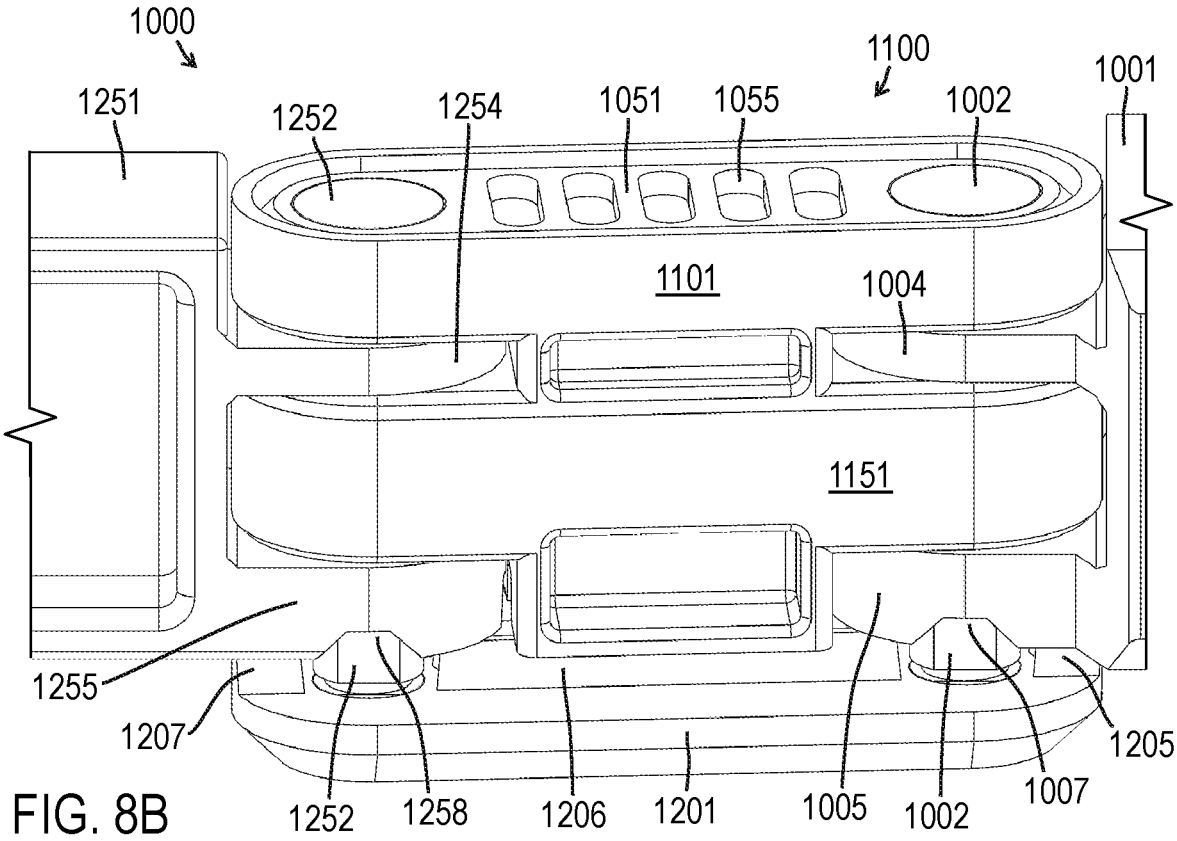
FIG. 8B is a right partial perspective view of the folding stock assembly of FIG. 1 with a fold lock mechanism in a deployed configuration.

Movement of the fold lock mechanism 1100 is shown in FIGS. 8A and 8B. A retracted configuration (i.e., the default position) of the fold lock mechanism 1100 is shown in FIG. 8A. In some embodiments, in the retracted configuration, the dynamic component(s) are biased in the vertical/upward direction relative to the static component(s) (e.g., due to spring 1451). Other examples of the retracted configuration are shown in, for example, FIGS. 3B, 3C, 4B, and 4C. The retracted configuration of the fold lock mechanism 1100 merely refers to the vertical position of the dynamic component(s) relative to the static component(s) and can occur in multiple rotational configurations of the folding stock assembly 1000. FIG. 8B illustrates a deployed configuration of the fold lock mechanism 1100. In some embodiments, to move the fold lock mechanism 1100 from the retracted configuration (FIG. 8A) to the deployed configuration (FIG. 8B), the operator pushes the upper surface of the actuation portion 1051 downward such that the dynamic components move down relative to the static components, which compresses spring 1451. The upper surface of the actuation portion 1051 may include knurling 1055 or serrations 1055 to enhance grip and/or as a visual indication of the function of the actuation portion 1051. As shown in FIG. 8B, in the deployed configuration, the actuation portion 1051, the hinge pins 1002, 1252, and the latch portion 1201 (i.e., the dynamic components) are in a downward position relative to the upper hinge body 1101, the lower hinge body 1151, the forward hinge fitting 1001, and the rear hinge fitting 1251 (i.e., the static components).

The fold lock mechanism 1100 may allow the operator to control movement between the various rotational configurations described above (the rearward configuration, the left side folded configuration, the right side folded configuration, and the partially folded configurations), including those shown in FIGS. 1-4C. As described above, the fold lock mechanism 1100 includes (i) the retracted configuration in which rotational movement of the components of the folding stock assembly 1000 is constrained/limited (see, e.g., FIG. 8A) and (ii) the deployed configuration where (based on operator input) the components of the folding stock assembly 1000 can move and/or rotate relative to one another (see, e.g., FIG. 8B). In some embodiments, the fold lock mechanism 1100 constrains rotational movement of the folding stock assembly 1000 based on interfaces between (i) at least one protrusion (forward protrusion 1205, central protrusion 1206, and/or rear protrusion 1207) of latch portion 1201 and (ii) at least one notch (notches 1006-1009, notches 1256-1259, and/or notch 1153) of the forward hinge fitting 1001, the rear hinge fitting 1251, and/or the lower hinge body 1151.

In some embodiments, the fold lock mechanism 1100 can be placed in the retracted configuration when the folding stock assembly 1000 is arranged in three different configurations. For example, the fold lock mechanism 1100 can move to the retracted configuration when the folding stock assembly 1000 is in the rearward configuration (see FIGS. 1, 2, 5A, and 5B). The fold lock mechanism 1100 can also move to the retracted configuration when the folding stock assembly 1000 is in the left side folded configuration (see FIGS. 3A-3C). The fold lock mechanism 1100 can also move to the retracted configuration when the folding stock assembly 1000 is in the right side folded configuration (see FIGS. 4A-4C).

Figure 5A:
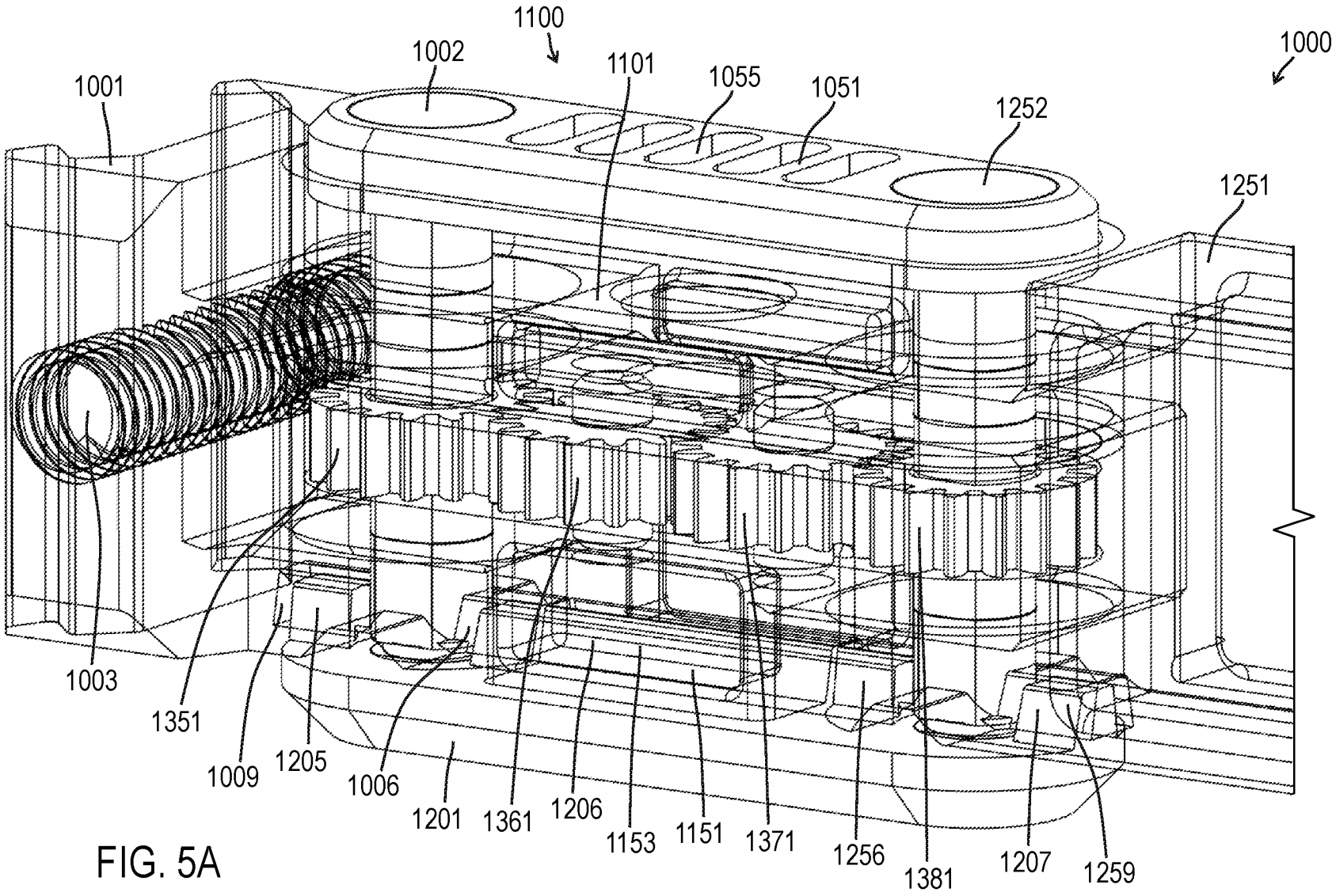
FIG. 5A is a left partial perspective view of folding stock assembly of FIG. 1.
Figure 5B:
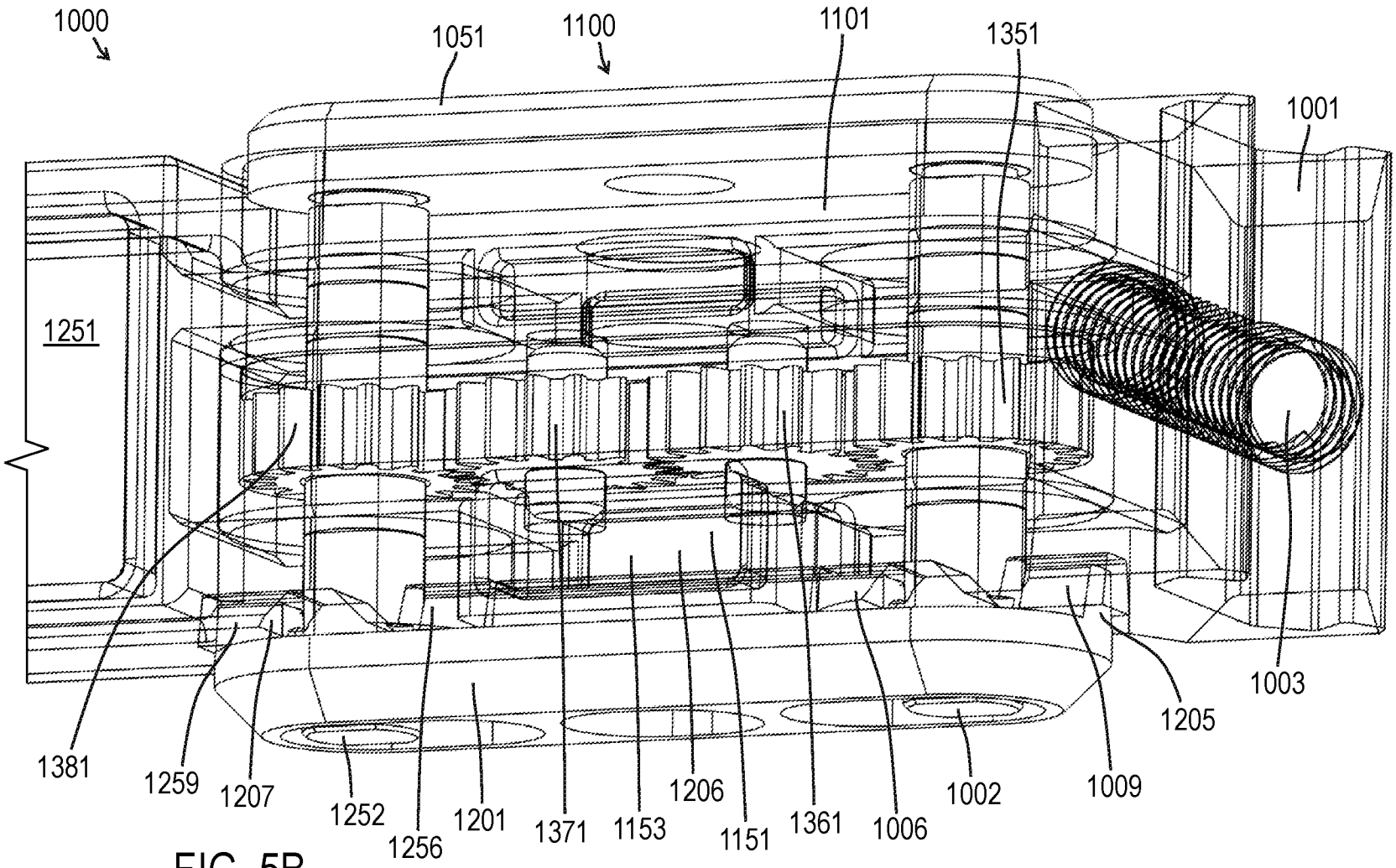
FIG. 5B is a right partial perspective view of the folding stock assembly of FIG. 5A.

FIGS. 1 and 2 illustrate one example of the fold lock mechanism 1100 in the retracted configuration when the folding stock assembly 1000 is in the rearward configuration. FIGS. 5A and 5B show detailed views of this same configuration where the upper hinge body 1101, the lower hinge body 1151, the forward hinge fitting 1001, and the rear hinge fitting 1251 are transparent. As shown in FIGS. 5A and 5B, when the folding stock assembly 1000 is in the rearward configuration and the fold lock mechanism 1100 is in the retracted configuration, the forward protrusion 1205 of the latch portion 1201 engages the forward notch 1009 of the forward hinge fitting 1001, the central protrusion 1206 of the latch portion 1201 engages the notch 1153 of the lower hinge body 1151, and the rear protrusion 1207 of the latch portion 1201 engages the rear notch 1259 of the rear hinge fitting 1251. In some embodiments, the central protrusion 1206 also engages the rear notch 1006 and the forward notch 1256 (in addition to notch 1153 of the lower hinge body 1151).

Figure 3A:
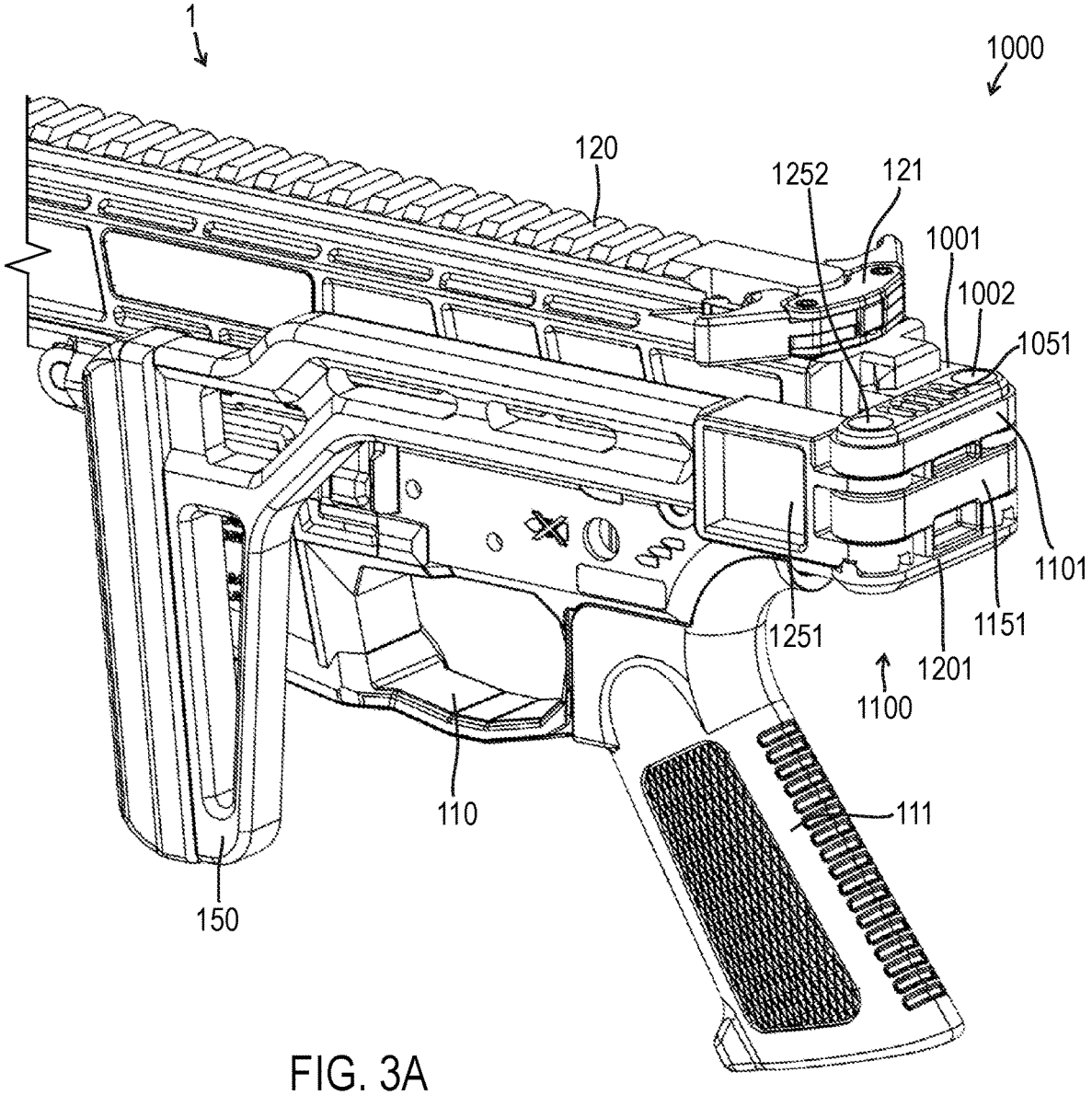
FIG. 3A is a left perspective view of the firearm with folding stock assembly of FIG. 1 in a left side folded configuration.
Figure 3B:
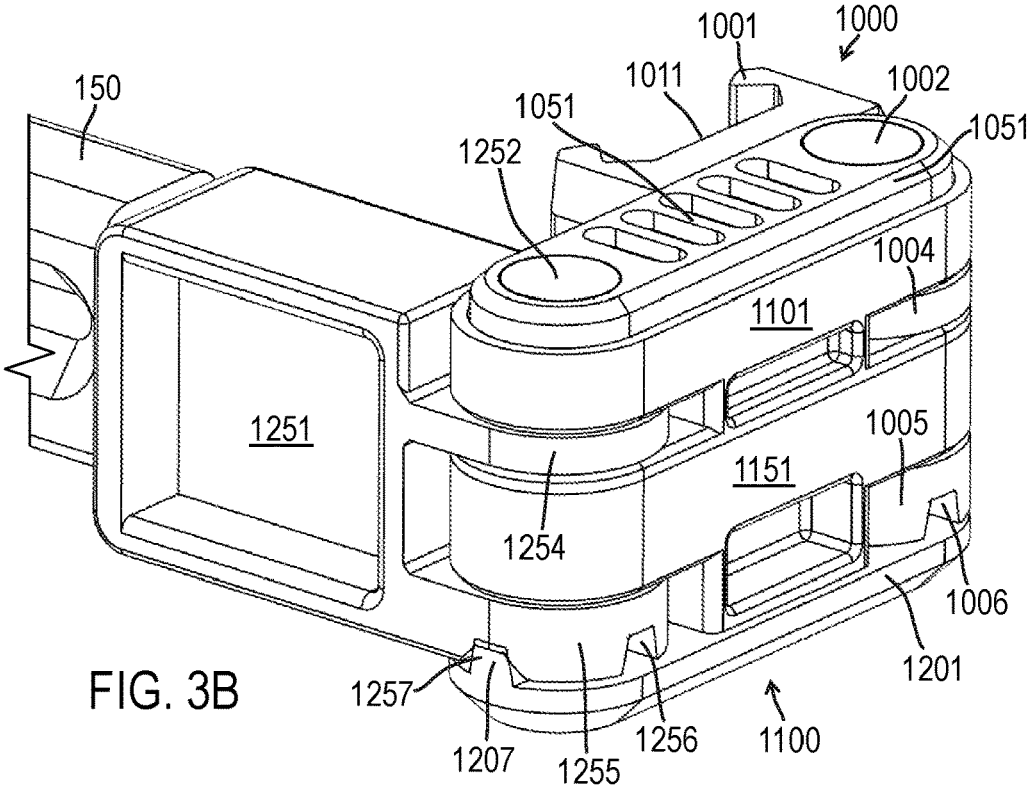
FIG. 3B is a left perspective view of the folding stock assembly of FIG. 3A.
Figure 3C:
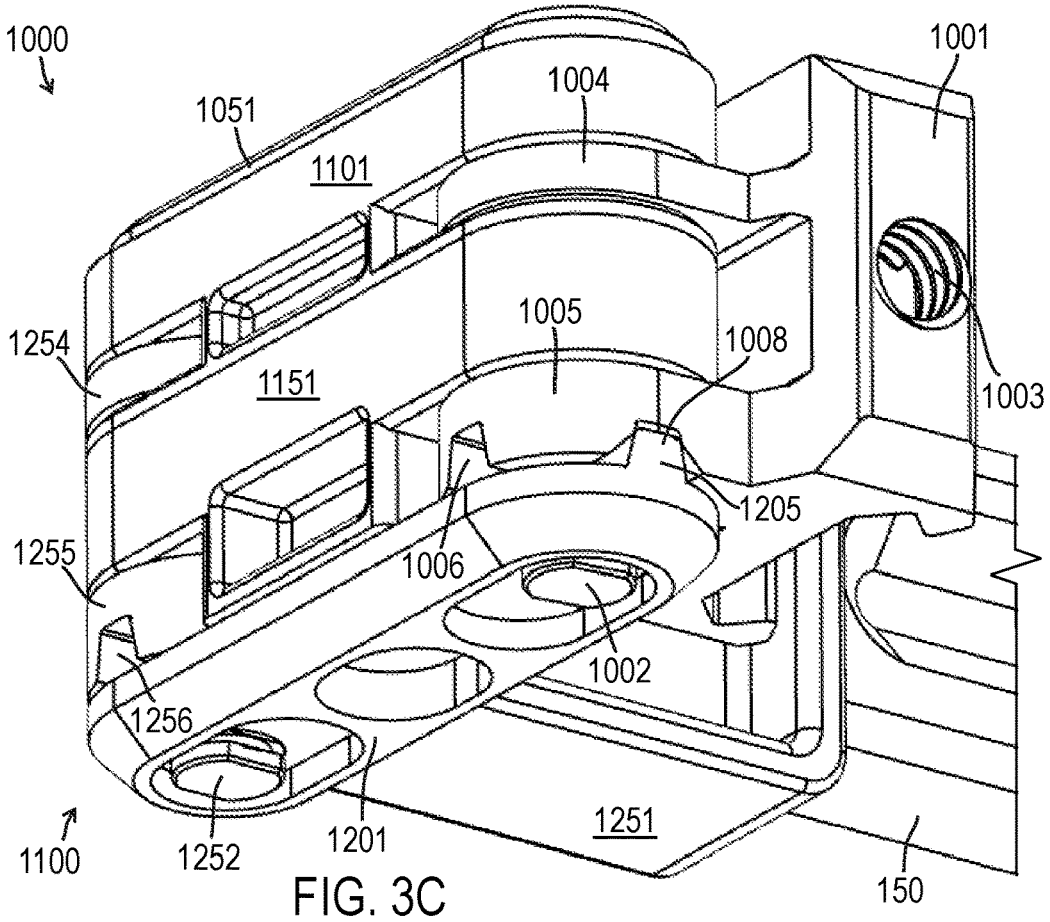
FIG. 3C is a right perspective view of the folding stock assembly of FIG. 3A.

FIG. 3A illustrates one example of the fold lock mechanism 1100 in the retracted configuration when the folding stock assembly 1000 is in the left side folded configuration. As shown in FIGS. 3B and 3C, when the folding stock assembly 1000 is in the left side folded configuration and the fold lock mechanism 1100 is in the retracted configuration, the forward protrusion 1205 of the latch portion 1201 engages the second lateral notch 1008 of the forward hinge fitting 1001 and the rear protrusion 1207 of the latch portion 1201 engages the first lateral notch 1257 of the rear hinge fitting 1251. In some embodiments, the central protrusion 1206 of the latch portion 1201 engages the notch 1153 of the lower hinge body 1151 (similar to rearward configuration described above). The engagement between these protrusions (1205, 1206, 1207) and notches (1008, 1153, 1257) acts as both a fold lock to secure the stock 150 in the folded position and as a stop or limit to prevent the stock 150 from folding too far and contacting the firearm 1. Conventional firearms with folding stocks lack these two features.

Figure 4A:
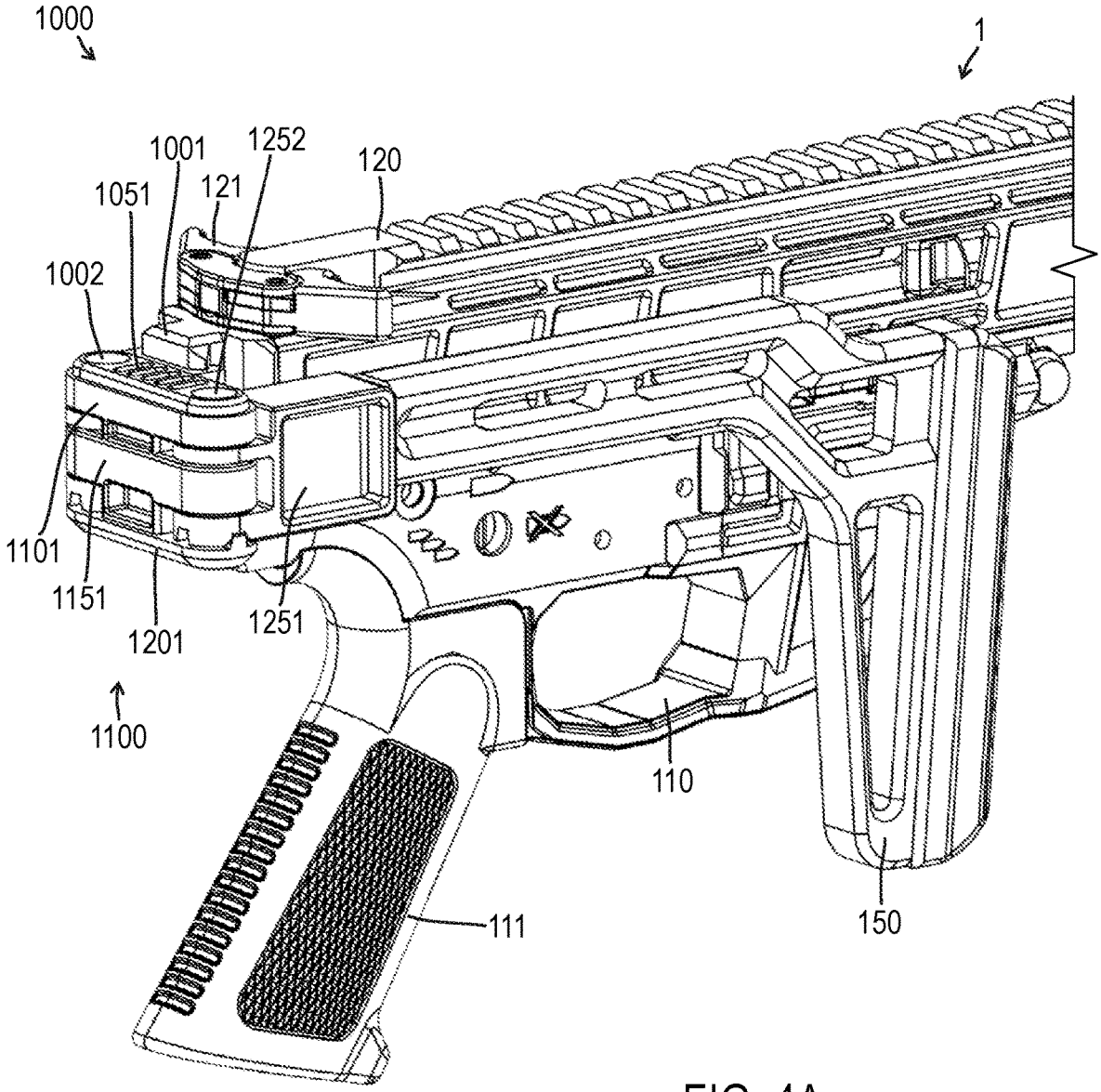
FIG. 4A is a right perspective view of the firearm with folding stock assembly of FIG. 1 in a right side folded configuration.
Figure 4B:
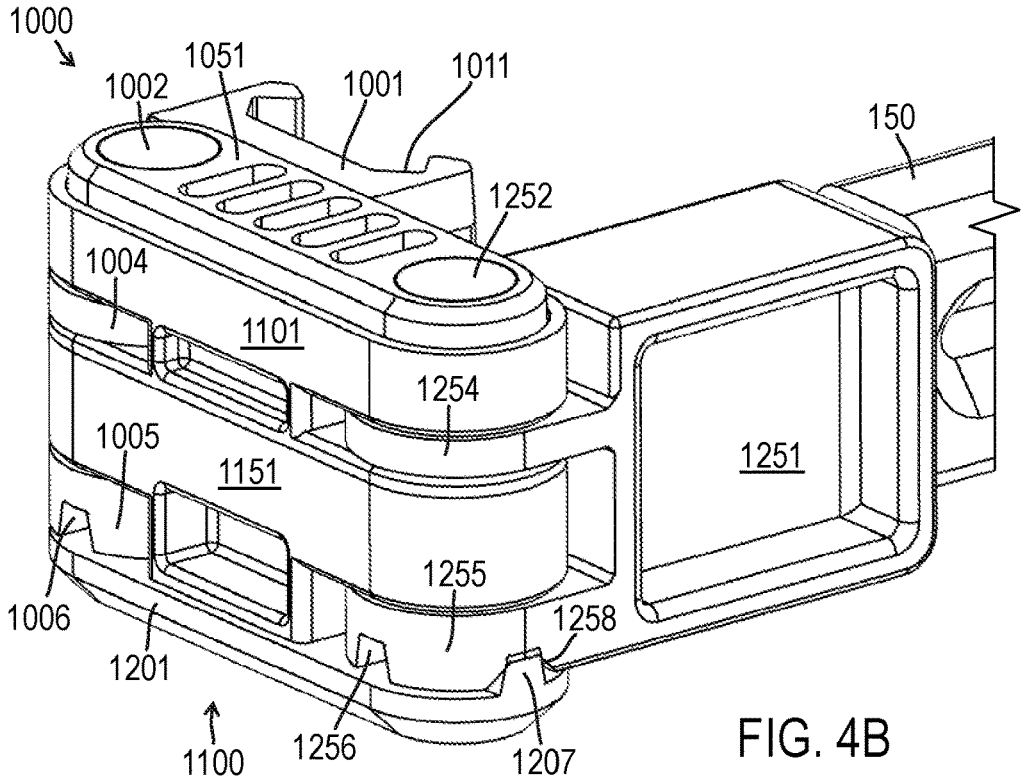
FIG. 4B is a right perspective view of the folding stock assembly of FIG. 4A.
Figure 4C:
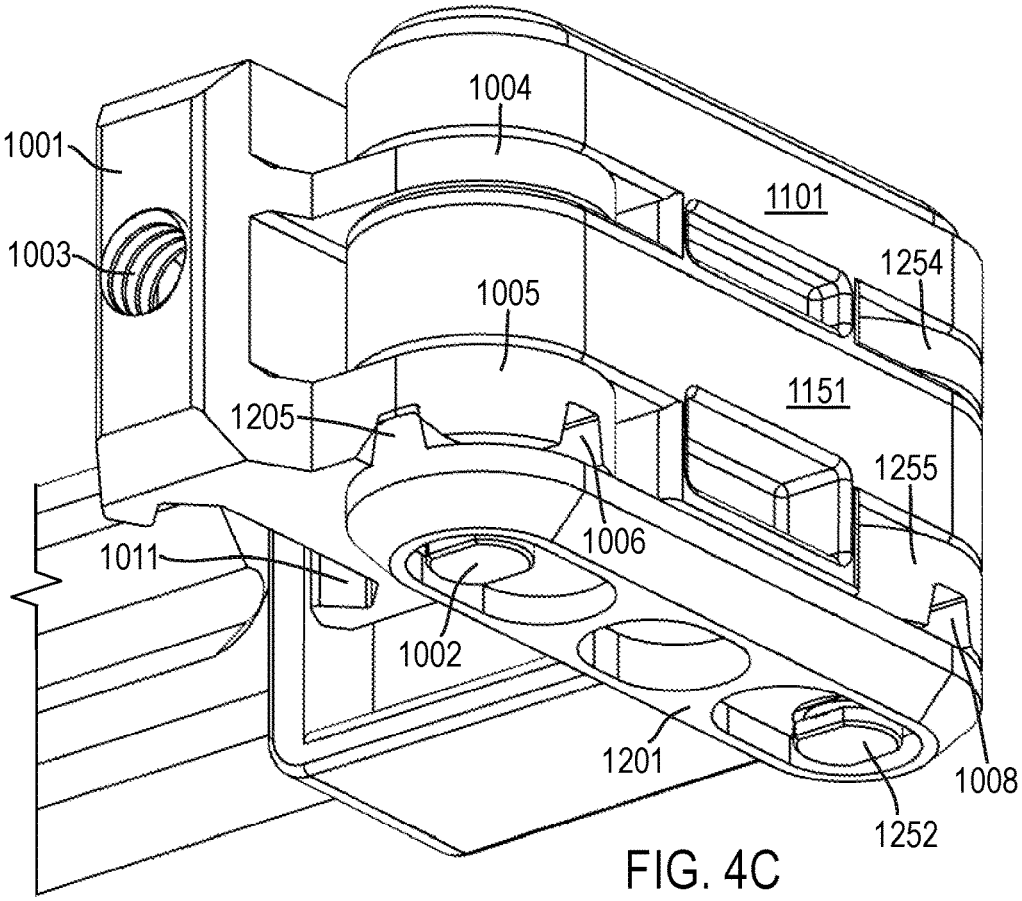
FIG. 4C is a left perspective view of the folding stock assembly of FIG. 4A.

FIG. 4A illustrates one example of the fold lock mechanism 1100 in the retracted configuration when the folding stock assembly 1000 is in the right side folded configuration. As shown in FIGS. 4B and 4C, when the folding stock assembly 1000 is in the right side folded configuration and the fold lock mechanism 1100 is in the retracted configuration, the forward protrusion 1205 of the latch portion 1201 engages the first lateral notch 1007 of the forward hinge fitting 1001 and the rear protrusion 1207 of the latch portion 1201 engages the second lateral notch 1258 of the rear hinge fitting 1251. In some embodiments, the central protrusion 1206 of the latch portion 1201 engages the notch 1153 of the lower hinge body 1151 (similar to rearward configuration and the left side folded configuration described above). The engagement between these protrusions (1205, 1206, 1207) and notches (1007, 1153, 1258) acts as both a fold lock to secure the stock 150 in the folded position and as a stop or limit to prevent the stock 150 from folding too far and contacting the firearm 1. Conventional firearms with folding stocks lack these two features.

FIG. 8B illustrates an example of the deployed configuration where downward pressure on the upper surface (e.g., serrations/knurling 1055) of the actuation portion 1051 causes the latch portion 1201 to move downward such that forward protrusion 1205, central protrusion 1206, and rear protrusion 1207 each disengage from any/all corresponding feature (e.g., see description of various retracted configurations above). Disengagement of the protrusions 1205-1207 from the relevant corresponding feature allows the central assembly to rotate relative to (i) the forward hinge fitting 1001, (ii) the rear hinge fitting 1251, or (iii) both the forward hinge fitting 1001 and the rear hinge fitting 1251. For example, the central assembly may rotate about forward hinge pin 1002 relative to the forward hinge fitting 1001. In addition, the central assembly may rotate about rear hinge pin 1252 relative to the rear hinge fitting 1251.

In some embodiments, in the retracted configuration, a portion of the actuation portion 1051 is disposed within the cavity 1108 of the upper hinge body 1101 while an upper portion of the actuation portion 1051 is located above the upper hinge body 1101 (see FIG. 8A). In the deployed configuration, the actuation portion 1051 moves downward relative to the upper hinge body 1101 such that the upper surface (e.g., serrations/knurling 1055) of the actuation portion 1051 is approximately flush with the top of the upper hinge body 1101. In some cases, the upper surface of the actuation portion 1051 protrudes slightly above the top of the upper hinge body 1101 (i.e., the entire actuation portion 1051 is not located within the cavity 1108). In other cases, the upper surface of the actuation portion 1051 is below the top of the upper hinge body 1101 (i.e., the entire actuation portion 1051 is located within the cavity 1108).

Rotation of the central assembly about the forward hinge pin 1002 may be independent and unrelated to rotation of the central assembly about rear hinge pin 1252. In some embodiments, rotation about the forward hinge pin 1002 is controlled relative to rotation about rear hinge pin 1252. In some cases, rotation about the two hinge pins 1002, 1252 is controlled to be approximately 1:1. In other cases, the rotation may be controlled at a different ratio between the two axes (e.g., 1:1.1, 1:1.5, 1:2, etc.).

Figure 6A:
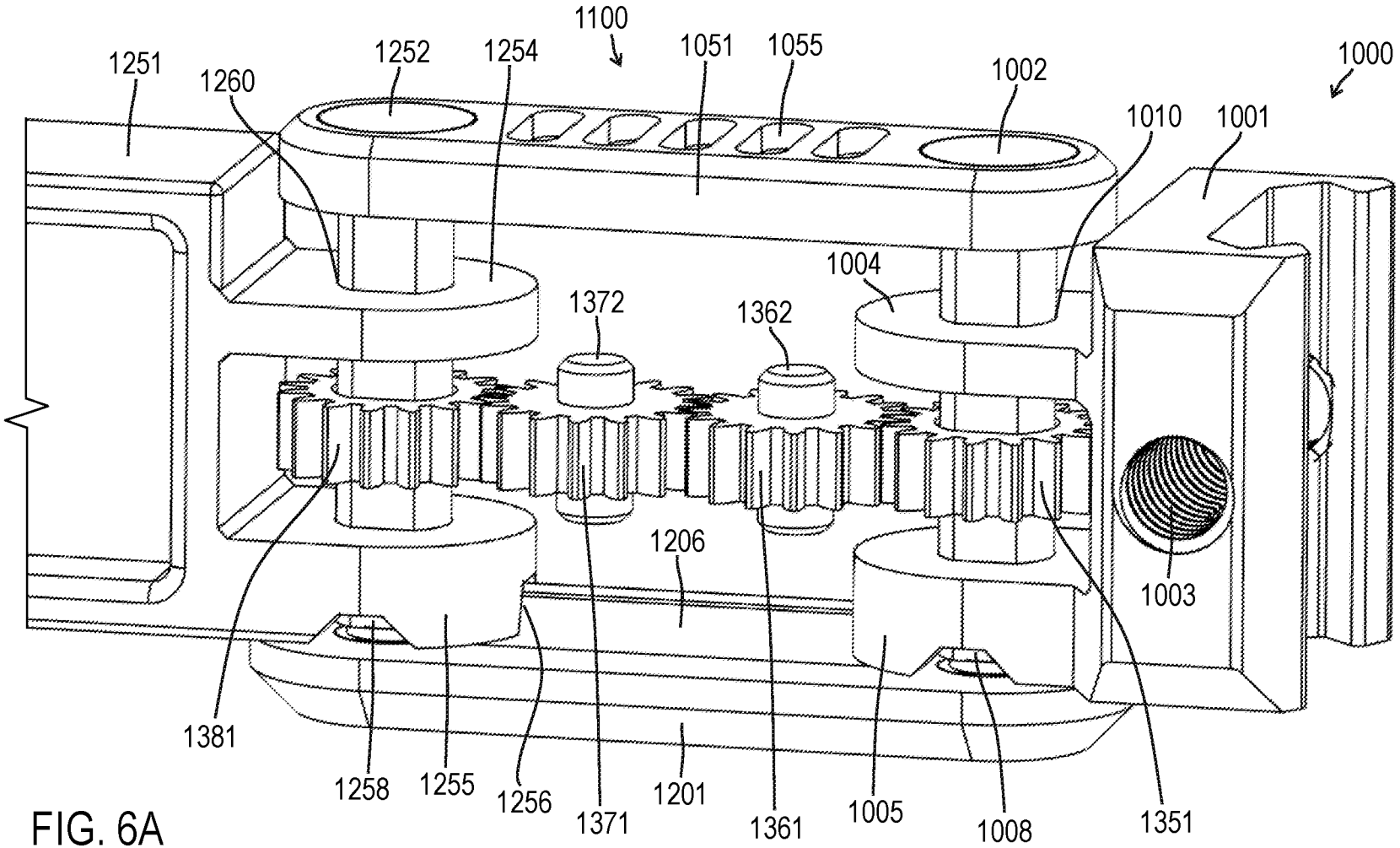
FIG. 6A is a right partial perspective view of the folding stock assembly of FIG. 1.

In some embodiments, as shown in FIGS. 5A-6A and 7, the folding stock assembly 1000 includes a gear mechanism for controlling rotation of the components. The gear mechanism may be located within cavity 1158 of the lower hinge body 1151 (i.e., below the lower protrusion 1109 of the upper hinge body 1101). FIG. 6A shows the gear mechanism with the upper hinge body 1101 and the lower hinge body 1151 hidden for clarity. In some embodiments, the forward hinge pin 1002 includes a forward gear 1351 and the rear hinge pin 1252 includes a rear gear 1381. The folding stock assembly 1000 may also include a forward intermediate gear 1361 and a rear intermediate gear 1371. The forward intermediate gear 1361 may rotate about a forward intermediate shaft 1362 which is located/fixed by recess 1111 of the upper hinge body 1101 and recess 1161 of the lower hinge body 1151. The rear intermediate gear 1371 may rotate about a rear intermediate shaft 1372 which is located/fixed by recess 1112 of the upper hinge body 1101 and recess 1162 of the lower hinge body 1151.

The four gears 1351, 1361, 1371, 1381 may mesh such that rotational movement about one of the hinge pins 1002, 1252 is equal and concurrent with rotation about the other. As shown in FIGS. 6A-7, the shaft of each of the hinge pins 1002, 1252 may be configured with a non-circular cross-section such that the flat surfaces of the hinge pins 1002, 1252 engage the corresponding portions of the pivot holes 1010, 1260 such that the hinge pins 1002, 1252 do not rotate relative to the corresponding hinge fitting 1001, 1251. In some cases, the forward and rear gears 1351, 1381 have a similar internal shape to pivot holes 1010, 1260 (i.e., to cause the gears to rotate along with the corresponding hinge pin 1002, 1252 and hinge fitting 1001, 1251). For example, in some embodiments, when the folding stock assembly 1000 moves from the rearward configuration (see FIGS. 1 and 2) to the left side folded configuration (see FIGS. 3A-3C), the motion of the stock 150 causes rear hinge pin 1252 to rotate in a clockwise direction (when viewed from above) relative to the central assembly. Due to the gear mechanism, the clockwise rotation of rear hinge pin 1252 causes a corresponding and equal counter-clockwise rotation (when viewed from above) of the forward hinge pin 1002 relative to the central assembly. When the folding stock assembly 1000 moves from the rearward configuration (see FIGS. 1 and 2) to the right side folded configuration (see FIGS. 4A-4C), the motion of the stock 150 causes rear hinge pin 1252 to rotate in a counter-clockwise direction (when viewed from above) relative to the central assembly. Due to the gear mechanism, the counter-clockwise rotation of rear hinge pin 1252 causes a corresponding and equal clockwise rotation (when viewed from above) of the forward hinge pin 1002 relative to the central assembly.

Figure 6B:
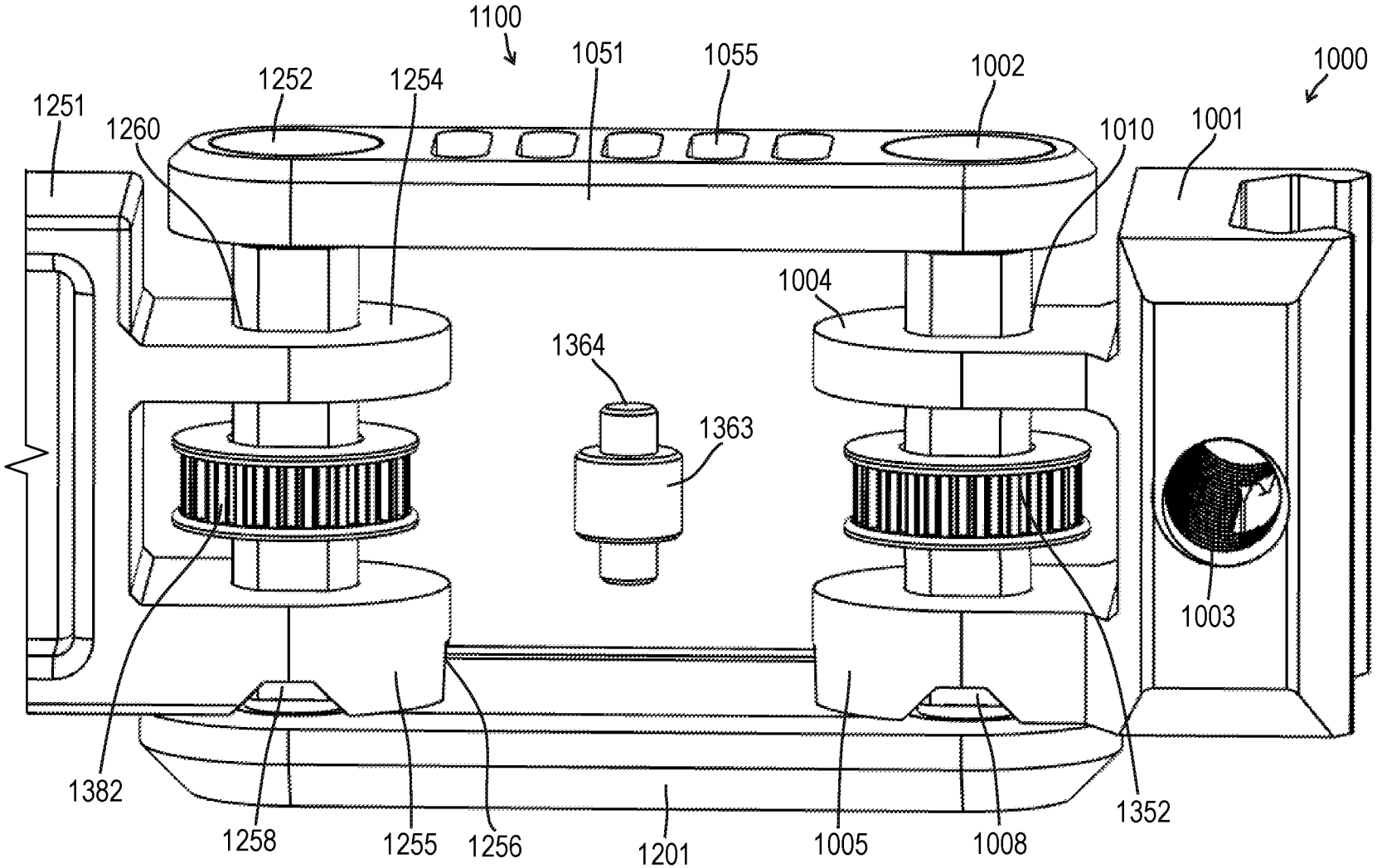
FIG. 6B is a right partial perspective view of the folding stock assembly of FIG. 1.

In some embodiments, as an alternative to the gear mechanism, the folding stock assembly 1000 may include a belt mechanism (see FIG. 6B). The belt mechanism (like the gear mechanism) may be located within cavity 1158 of the lower hinge body 1151 (i.e., below the lower protrusion 1109 of the upper hinge body 1101). FIG. 6B shows the belt mechanism with the belt, the upper hinge body 1101, and the lower hinge body 1151 hidden for clarity. For the belt mechanism, the forward and rear gears 1351, 1381 would be replaced with a forward belt pulley 1352 and a rear belt pulley 1382, respectively. As shown in FIG. 6B, at least one of the pulleys 1352, 1382 may include notches, grooves, ribs, cogs, and/or teeth that interface with the belt (e.g., a link belt, a V-belt, a timing belt, etc.). In some embodiments, the belt mechanism includes an idler pulley 1363 that rotates on an intermediate shaft 1364 which is located/fixed by a recess of the upper hinge body 1101 and a recess of the lower hinge body 1151 (similar to intermediate shafts 1362, 1372). The idler pulley 1363 may be adjustable to increase/decrease tension on the belt.

In some embodiments, including illustrative examples shown in FIGS. 15-22, the firearm may include a folding stock assembly 2000, and a stock 150. The folding stock assembly 2000 may be fully ambidextrous such that the stock 150 can move based on the folding stock assembly 2000 moving between (i) the rearward configuration shown in FIG. 15, (ii) the left side folded configuration (similar to the configuration shown in FIGS. 3A-3C), (iii) the right side folded (similar to the configuration shown in FIGS. 4A-4C), and an infinite number of configurations between these configurations (i.e., various partially folded configurations).

As shown in FIGS. 15-17C, the folding stock assembly 2000 may include a forward hinge fitting 2001, a forward latch portion 2002, an actuation portion 2051, a hinge body 2101, a rear hinge fitting 2151, a rear latch portion 2152, and a fold lock mechanism 2100.

In addition, the configuration of folding stock assembly 2000 may allow each of the two axes A, B to rotate in opposite directions causing the stock 150 to extend rearward and be arranged parallel to the position shown in the rearward configuration but offset in the lateral direction. For example, the hinge body 2101 may rotate toward the right side of the firearm about axis A (a first hinge axis) and the rear hinge fitting 2151 may rotate in the opposite direction about axis B (a second hinge axis) such that the stock 150 extends rearward. In this configuration, the stock 150 is offset approximately the length of the hinge body 2101 toward the right side of the firearm, which may improve ergonomics for right handed operators who are wearing cumbersome equipment such as helmets, face shields, face guards, headwear, body armor, vests, jackets, and/or any other potential equipment/clothing.

Figure 21:
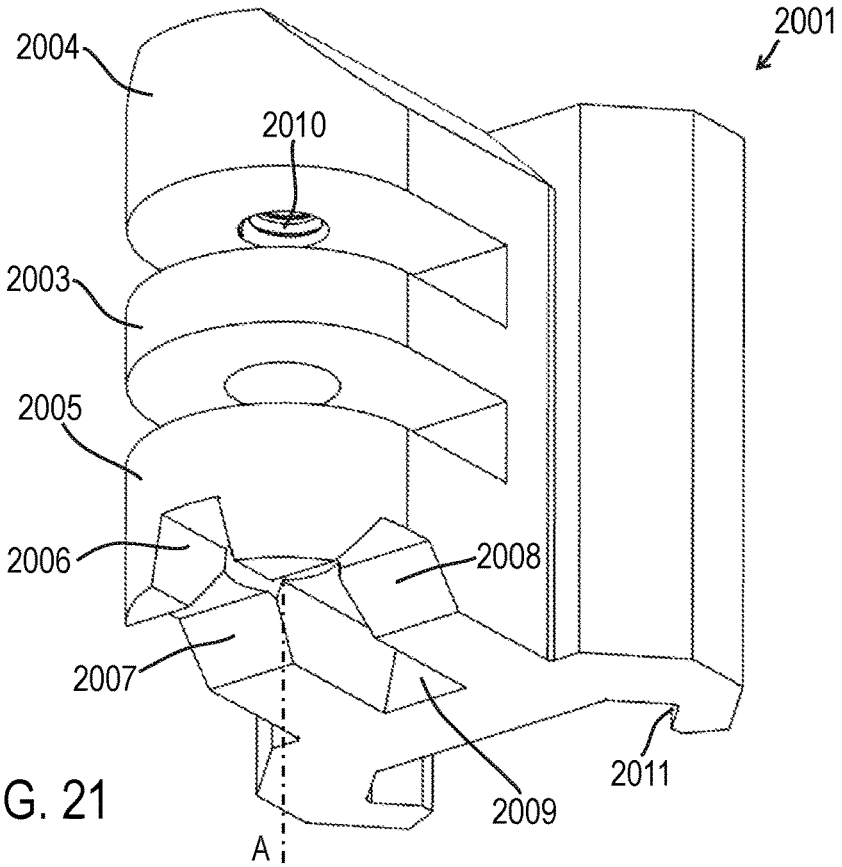
FIG. 21 is a rear perspective view of a forward hinge fitting of the folding stock assembly of FIG. 15.

The forward hinge fitting 2001, as shown in FIGS. 15-17C, may be removably attached to other portions of the firearm (e.g., to the lower receiver 110). However, in other embodiments, the forward hinge fitting 2001 is a permanent or integral component of the firearm. The forward hinge fitting 2001 may include an attachment portion 2011. In some cases, the attachment portion 2011 is a picatinny rail or weaver rail attachment. As shown in FIG. 21, on the rear side, the forward hinge fitting 2001 may include a pivot hole 2010 (aligned with axis A), a center lug 2003, an upper lug 2004, and a lower lug 2005. In some cases, the pivot hole 2010 extends through one or all of the center lug 2003, the upper lug 2004, and the lower lug 2005. The lower lug 2005 may include at least one notch for engaging the forward latch portion 2002. For example, the lower lug 2005 may include a rear notch 2006, a first lateral notch 2007, a second lateral notch 2008, and a forward notch 2009. The notches 2006-2009 may have different geometric properties that affect the function of the folding stock assembly 2000. For example, the lateral notches 2007, 2008 may have a more gradual taper or curve (compared to the rear notch 2006 and/or the forward notch 2009). The notches 2006-2009 are illustrated with straight tapers but one or more of the notches 2006-2009 may include a curved (non-linear) profile. In other embodiments, the notches 2006-2009 are all identical with the same geometric properties.

Figure 22:
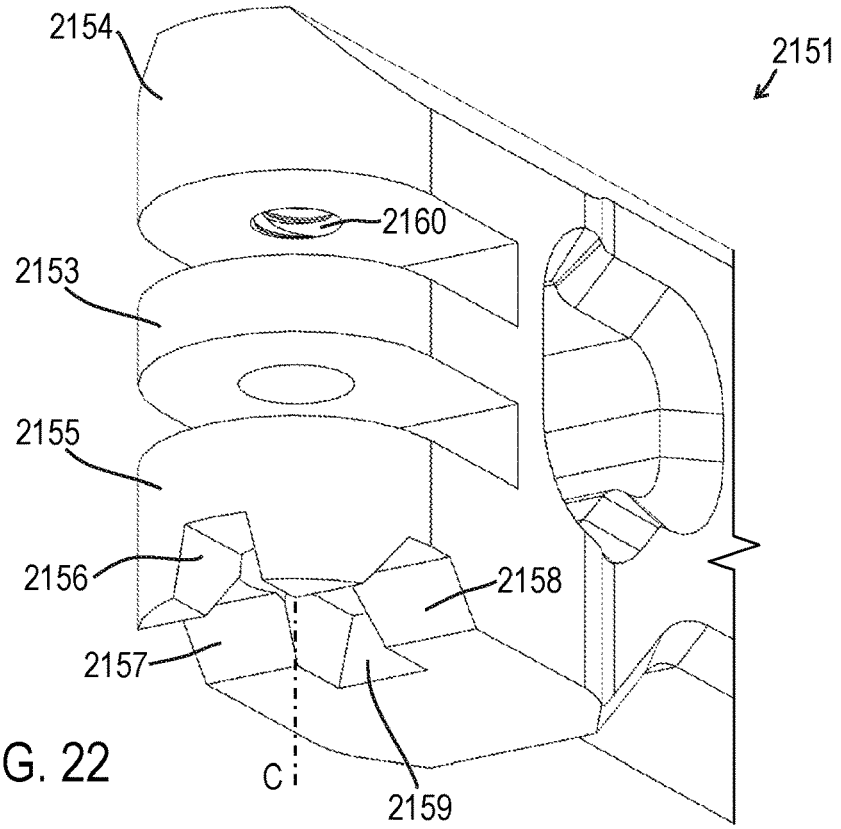
FIG. 22 is a forward perspective view of a rear hinge fitting of the folding stock assembly of FIG. 15.

The rear hinge fitting 2151, as shown in FIGS. 15-17C, may be attached to other portions of the firearm (e.g., to the stock 150). In some embodiments, the rear hinge fitting 2151 is removably attached to the stock 150 while in other cases, the rear hinge fitting 2151 and the stock 150 are integrally formed with one another. As shown in FIG. 22, on the rear side, the rear hinge fitting 2151 may include a pivot hole 2160 (aligned with axis C), a center lug 2153, an upper lug 2154, and a lower lug 2155. In some cases, the pivot hole 2160 extends through one or all of the center lug 2153, the upper lug 2154, and the lower lug 2155. The lower lug 2155 may include at least one notch for engaging the rear latch portion 2152. For example, the lower lug 2155 may include a forward notch 2156, a first lateral notch 2157, a second lateral notch 2158, and a rear notch 2159. The notches 2156-2159 may have different geometric properties that affect the function of the folding stock assembly 2000. For example, the lateral notches 2157, 2158 may have a more gradual taper or curve (compared to the forward notch 2156 and the rear notch 2159). The notches 2156-2159 are illustrated with straight tapers but one or more of the notches 2156-2159 may include a curved (non-linear) profile. In other embodiments, the notches 2156-2159 are all identical with the same geometric properties.

In some embodiments, where the lateral notches 2007, 2008, 2157, 2158 each include less steep or more gradual tapers/curves compared to the forward/rear notches 2006, 2009, 2156, 2159 (as shown in FIGS. 21 and 22), the function of the folding stock assembly 2000 can be tailored to different situations. For example, in some cases, the steeper profile of the forward/rear notches 2006, 2009, 2156, 2159 dictate that the folding stock assembly 2000 cannot be moved out of the rearward configuration (see FIG. 15) without fully depressing the actuation portion 2051. In other words, the folding stock assembly 2000 may be designed minimize or eliminate the chance of accidentally moving the stock 150 out of the rearward configuration. Conversely, the more gradual profile of the lateral notches 2007, 2008, 2157, 2158 may be configured such that the folding stock assembly 2000 can be moved out of the left side folded configuration and/or the right side folded configuration (e.g., similar to the configurations shown in FIGS. 3A-4C) with partial depressing of the actuation portion 2051 (or, in some cases, without any interaction with the actuation portion 2051). In other words, the folding stock assembly 2000 may be designed such that the operator can quickly pivot the stock 150 from the left side folded configuration and/or the right side folded configuration to the rearward configuration.

As shown in FIGS. 15-17C, in between the forward hinge fitting 2001 and the rear hinge fitting 2151, the folding stock assembly 2000 may have a central assembly that includes (i) the hinge body 2101 that interfaces with both the forward hinge fitting 2001 and the rear hinge fitting 2151 and (ii) the actuation portion 2051 that includes side members 2053*a*, 2053*b* (which interface with the lateral portions 2104*a*, 2104*b* of the hinge body 2101) and a lower portion 2055 disposed below the hinge body 2101. The central assembly is connected to the forward hinge fitting 2001 by a fastener or pin (not shown) which extends through (i) pivot hole 2010 of the forward hinge fitting 2001, (ii) hole 2102*a* of the hinge body 2101, and (iii) hole 2013 of the forward latch portion 2002 (the first hinge axis, axis A). The fastener may engage a threaded portion of hole 2010 near the top of the forward hinge fitting 2001 (e.g., see FIG. 21). There may be a spring disposed on or adjacent to the forward latch portion 2002 (in some cases along the shaft of the fastener) that biases the forward latch portion 2002 upward relative to the hinge body 2101 and the forward hinge fitting 2001. Similarly, the central assembly is connected to the rear hinge fitting 2151 by a fastener or pin (not shown) which extends through (i) pivot hole 2160 of the rear hinge fitting 2151, (ii) hole 2102*b* of the hinge body 2101, and (iii) hole 2013 of the rear latch portion 2152 (the second hinge axis, axis B). The fastener may engage a threaded portion of hole 2160 near the top of the rear hinge fitting 2151 (e.g., see FIG. 22). There may be a spring disposed on or adjacent to the rear latch portion 2152 (in some cases along the shaft of the fastener) that biases the rear latch portion 2152 upward relative to the hinge body 2101 and the rear hinge fitting 2151.

Figure 18A:
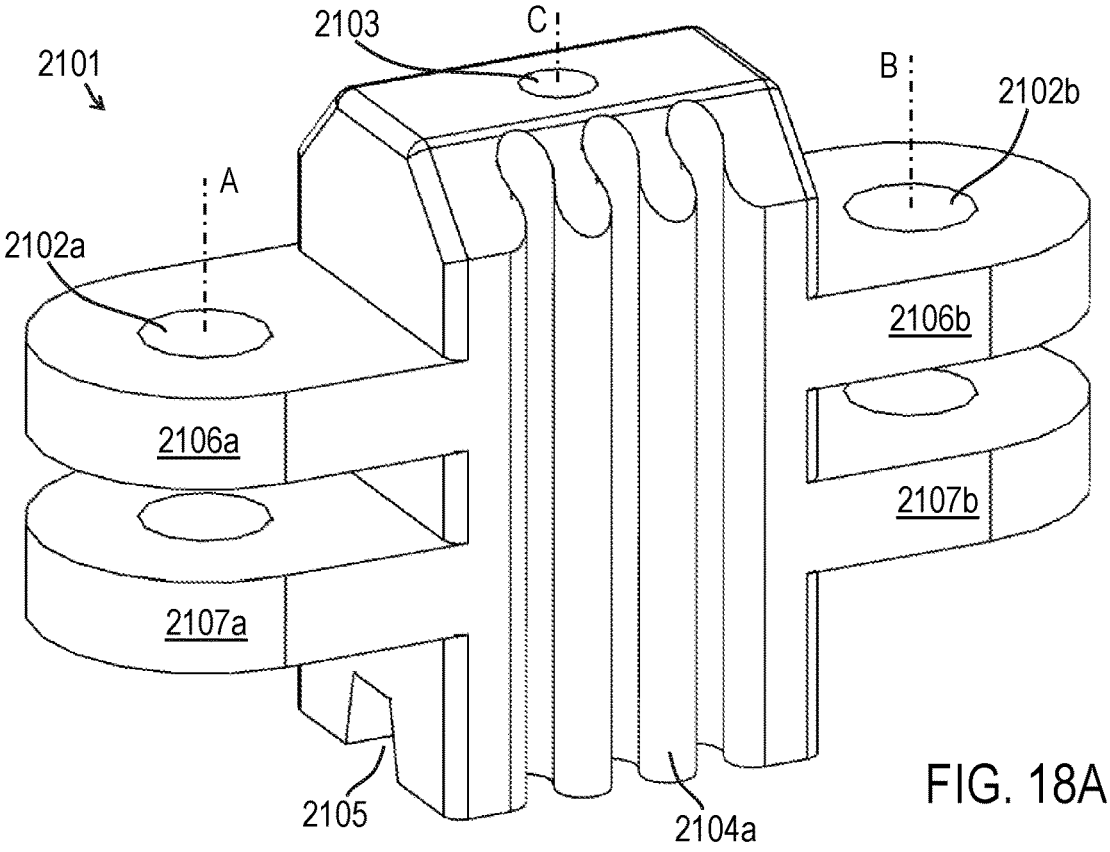
FIG. 18A is an upper perspective view of a hinge body of the folding stock assembly of FIG. 15.
Figure 18B:
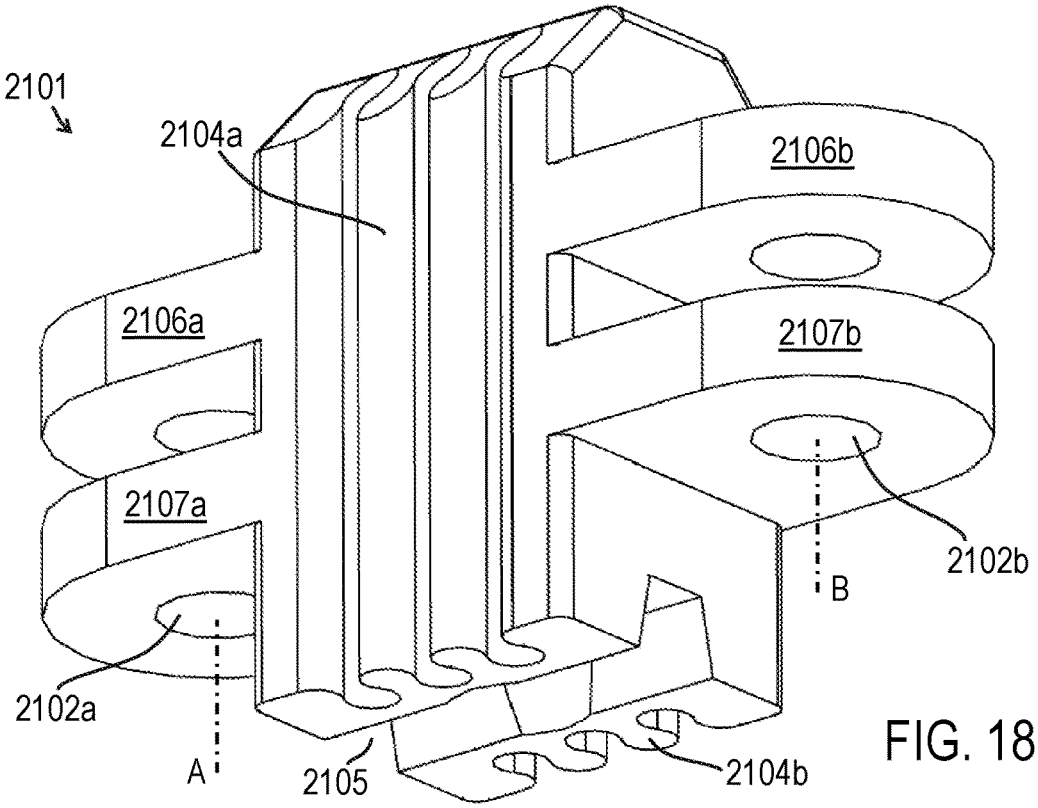
FIG. 18B is a bottom perspective view of the hinge body of FIG. 18A.
Figure 18C:
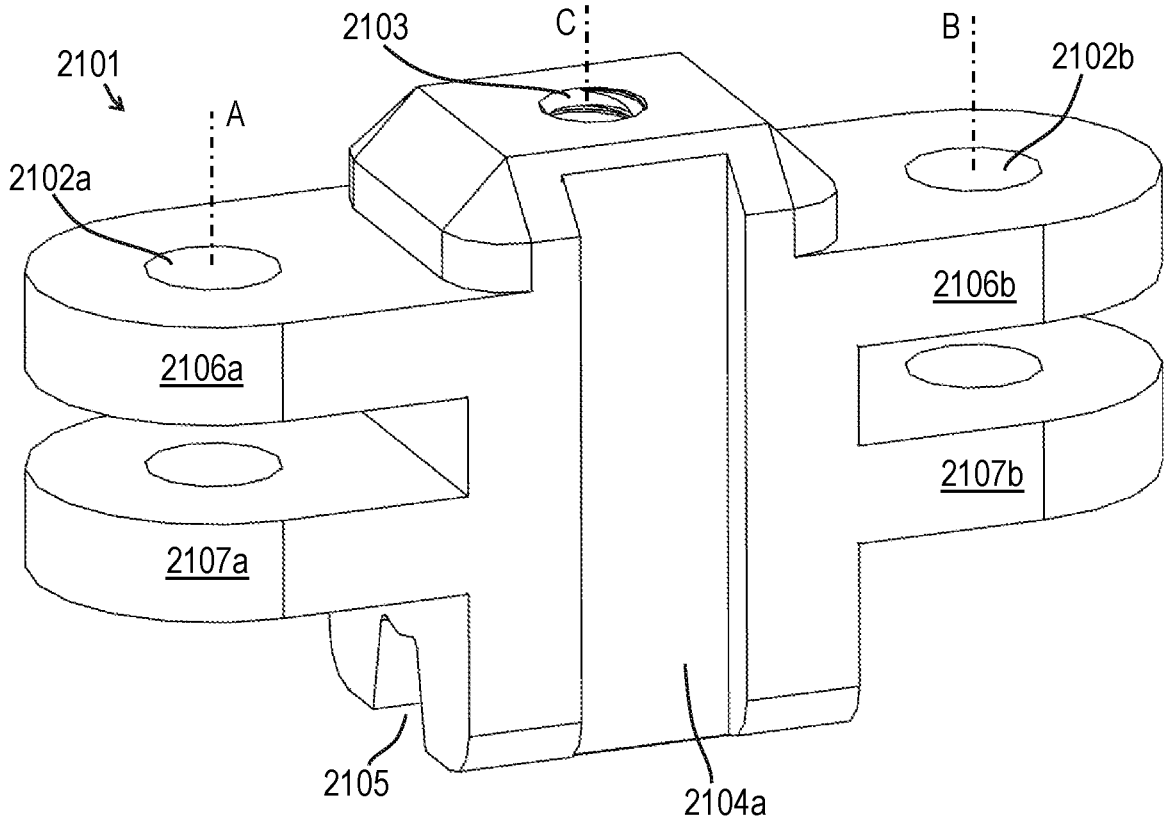
FIG. 18C is an upper perspective view of a hinge body of the folding stock assembly of FIG. 15.

In some embodiments, the hinge body 2101 is symmetric front and rear (i.e., the front and rear portions are identical). As shown in FIGS. 18A and 18B, the hinge body 2101 includes at least one lug on each end. For example, the forward end of the hinge body 2101 may include (i) an upper lug 2106*a* that may be arranged between the center lug 2003 and the upper lug 2004 (of the forward hinge fitting 2001) and (ii) a lower lug 2107*a* that may be arranged between the center lug 2003 and the lower lug 2005. Similarly, the rear end of the hinge body 2101 may include (i) an upper lug 2106*b* that may be arranged between the center lug 2153 and the upper lug 2154 and (ii) a lower lug 2107*b* that may be arranged between the center lug 2153 and the lower lug 2155 (of the rear hinge fitting 2151). The lateral portions 2104*a*, 2104*b* of the hinge body 2101 may be configured to slidably interface with engaging members 2054*a*, 2054*b* of the actuation portion 2051. For example, as shown in FIGS. 18A-19B, the lateral portions 2104*a*, 2104*b* and/or the engaging members 2054*a*, 2054*b* may each include at least one protrusion that is rounded/circular or partially rounded/circular (i.e., a circular cross-section). In some embodiments, the lateral portions 2104*a*, 2104*b* and/or the engaging members 2054*a*, 2054*b* may each include at least one protrusion with other shapes including rectangular (e.g., see FIG. 18C), square, oval, triangular, dovetail, other polygonal shapes, and/or any other appropriate shape.

Figure 19A:
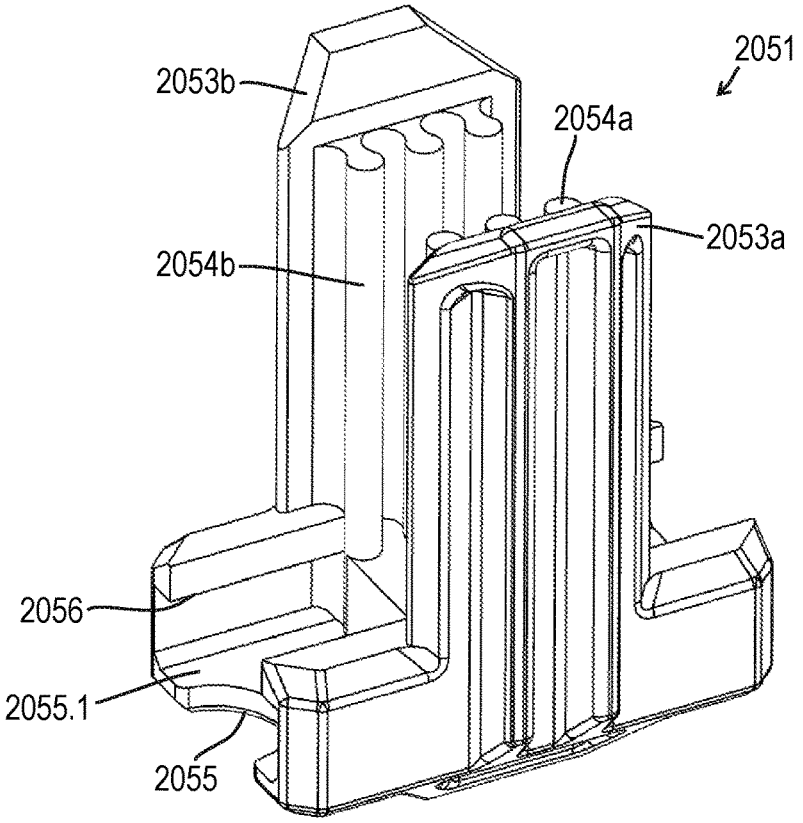
FIG. 19A is an upper perspective view of an actuation portion of the folding stock assembly of FIG. 15.
Figure 19B:
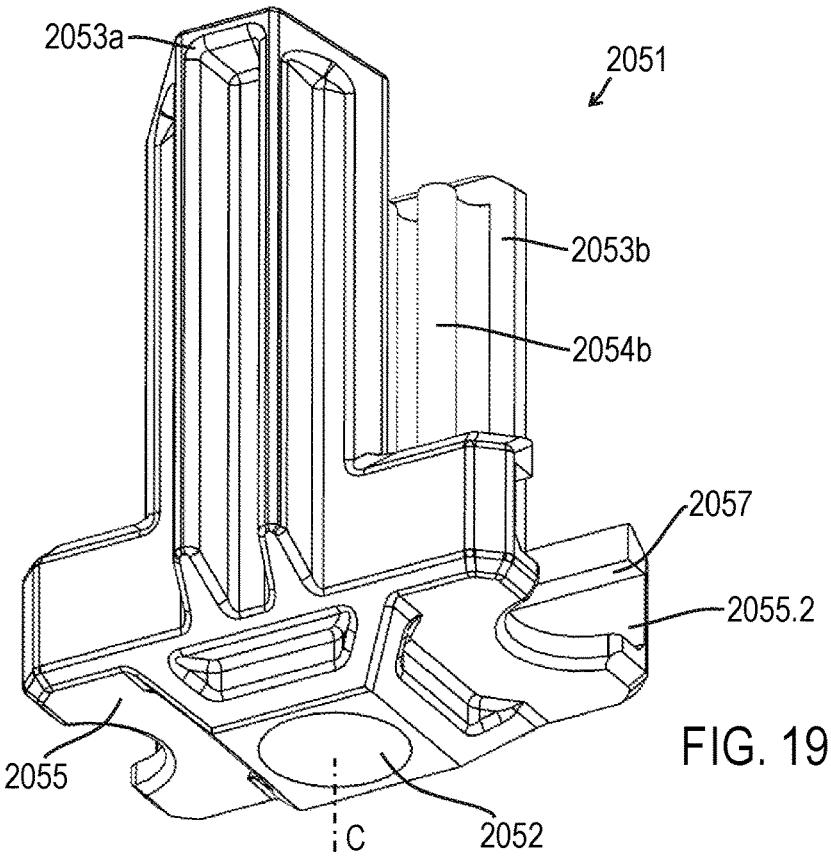
FIG. 19B is a bottom perspective view of the actuation portion of FIG. 19A.
Figure 20A:
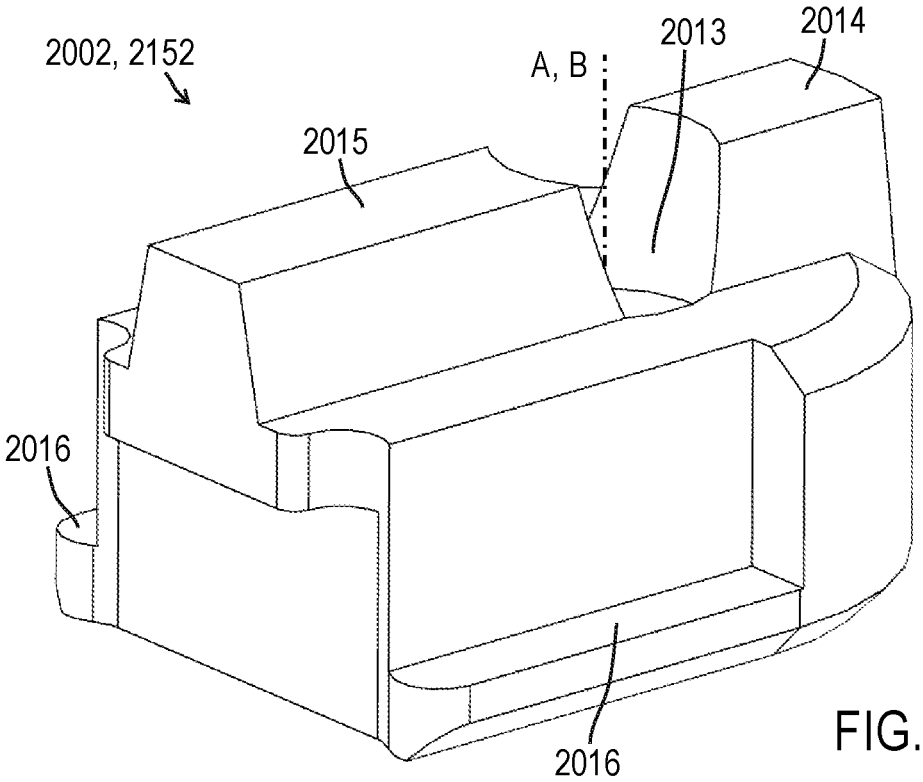
FIG. 20A is an upper perspective view of a latch portion of the folding stock assembly of FIG. 15.
Figure 20B:
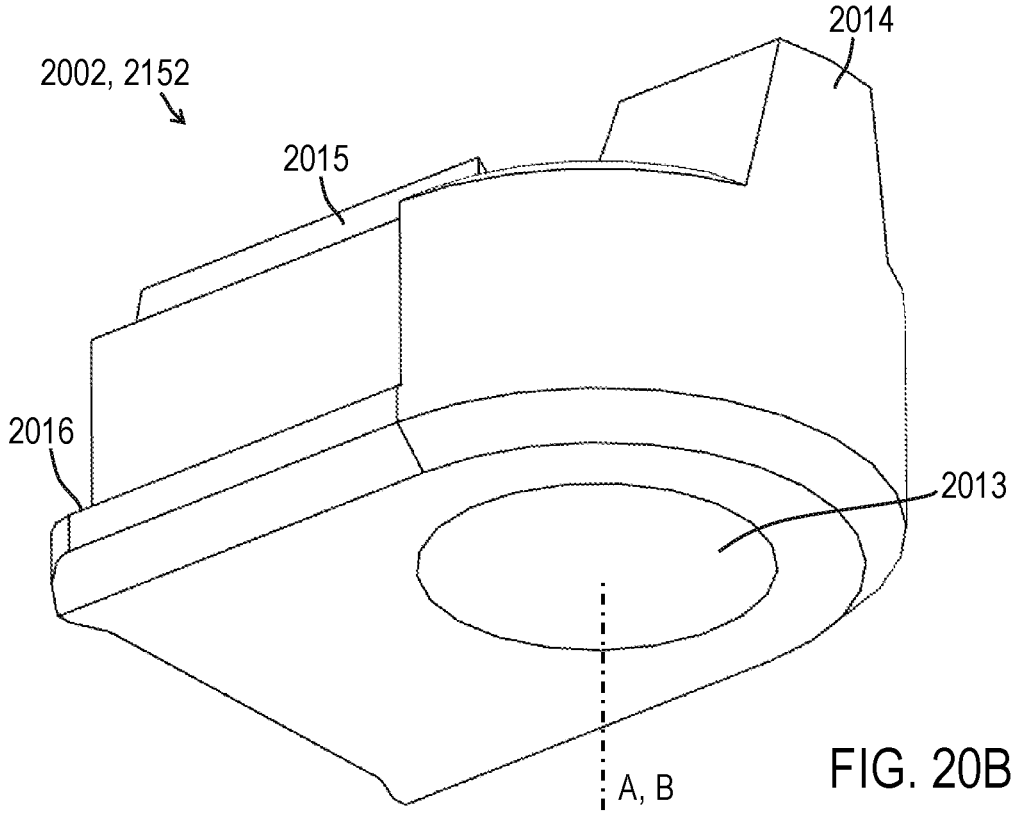
FIG. 20B is a bottom perspective view of the latch portion of FIG. 20A.

As shown in FIGS. 19A and 19B, the actuation portion 2051 may be symmetric front and rear (i.e., the front and rear portions are identical). In some cases, the actuation portion 2051 may be attached to the hinge body 2101 with a fastener (not shown) within hole 2052 that extends along axis C. The fastener may engage a threaded portion of hole 2103 near the top of the hinge body 2101. There may be a spring disposed on or adjacent to one of both of the actuation portion 2051 and the hinge body 2101 (in some cases along the shaft of the fastener) that biases the actuation portion 2051 upward relative to other components, including the hinge body 2101. The lower portion 2055 of the actuation portion 2051 may include a forward cavity 2055.1 and/or a rear cavity 2055.2. In some embodiments, the forward cavity 2055.1 interfaces with the forward latch portion 2002 and the rear cavity 2055.2 interfaces with the rear latch portion 2152.

In some embodiments, to operate the folding stock assembly 2000, the operator pushes the actuation portion 2051 downward (compressing the spring described above). Downward movement of the actuation portion 2051 may cause one or more contact members 2056 (within the forward cavity 2055.1) to engage a corresponding feature of the forward latch portion 2002. For example, in some embodiments, the contact member(s) 2056 may engage (i.e., press against) one or more surfaces 2016 of the forward latch portion 2002. Similarly, downward movement of the actuation portion 2051 may cause one or more contact members 2057 (within the rear cavity 2055.2) to engage a corresponding feature of the rear latch portion 2152. For example, in some embodiments, the contact member(s) 2057 may engage (i.e., press against) one or more surfaces 2016 of the rear latch portion 2152.

Figure 17A:
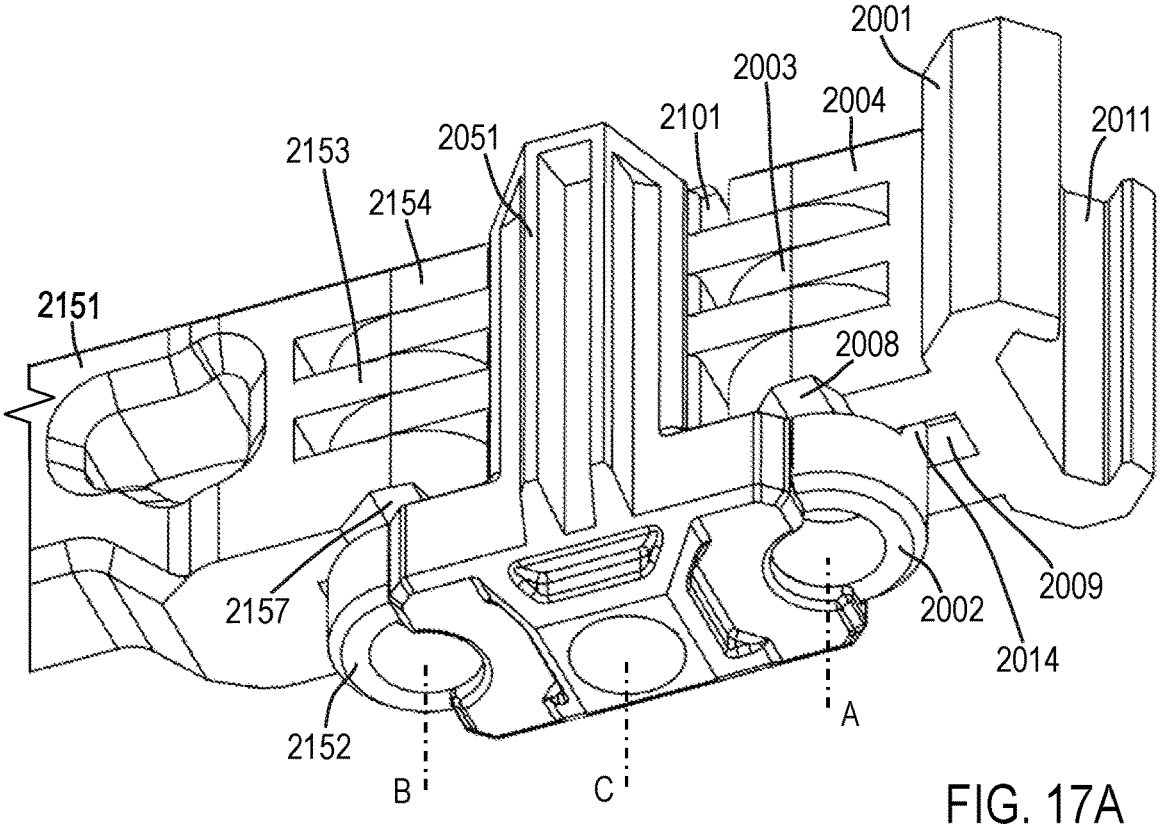
FIG. 17A is a right front bottom partial perspective view of the folding stock assembly of FIG. 15.
Figure 17B:
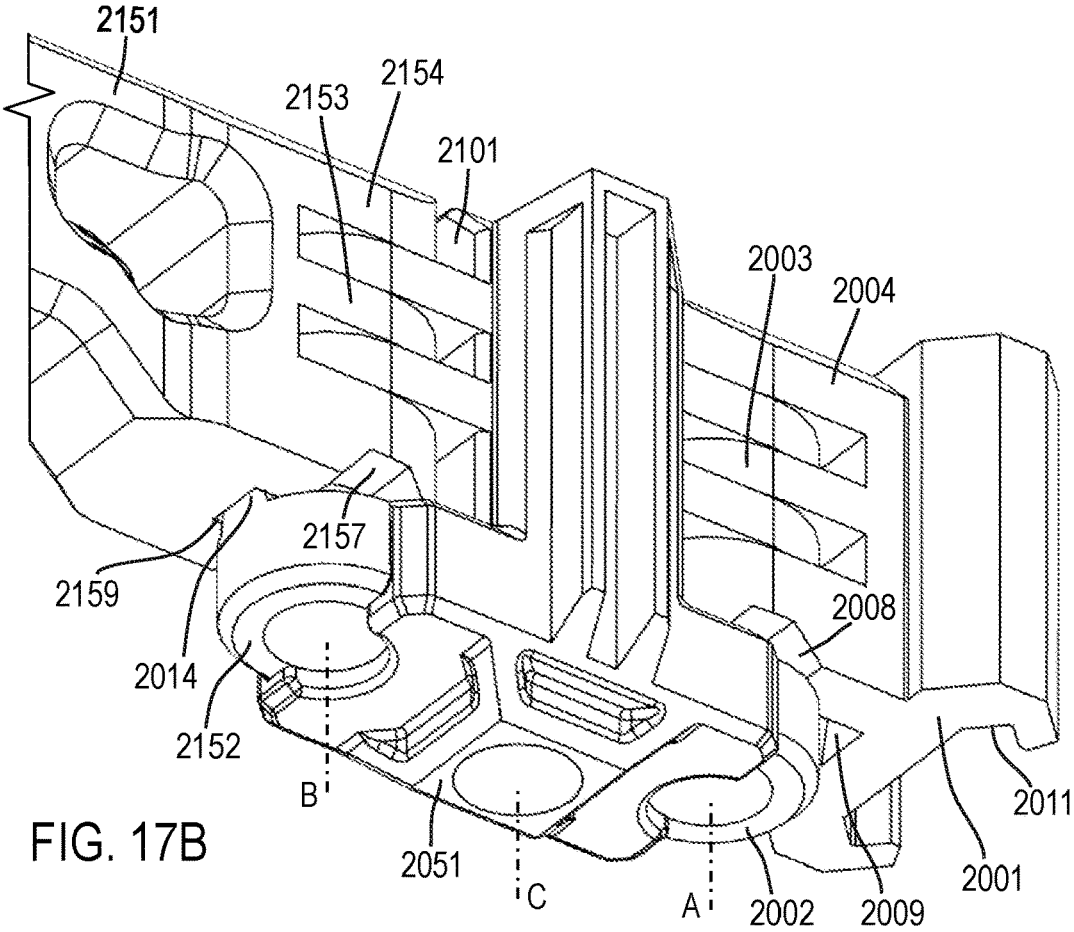
FIG. 17B is a right rear bottom partial perspective view of the folding stock assembly of FIG. 17A.
Figure 17C:
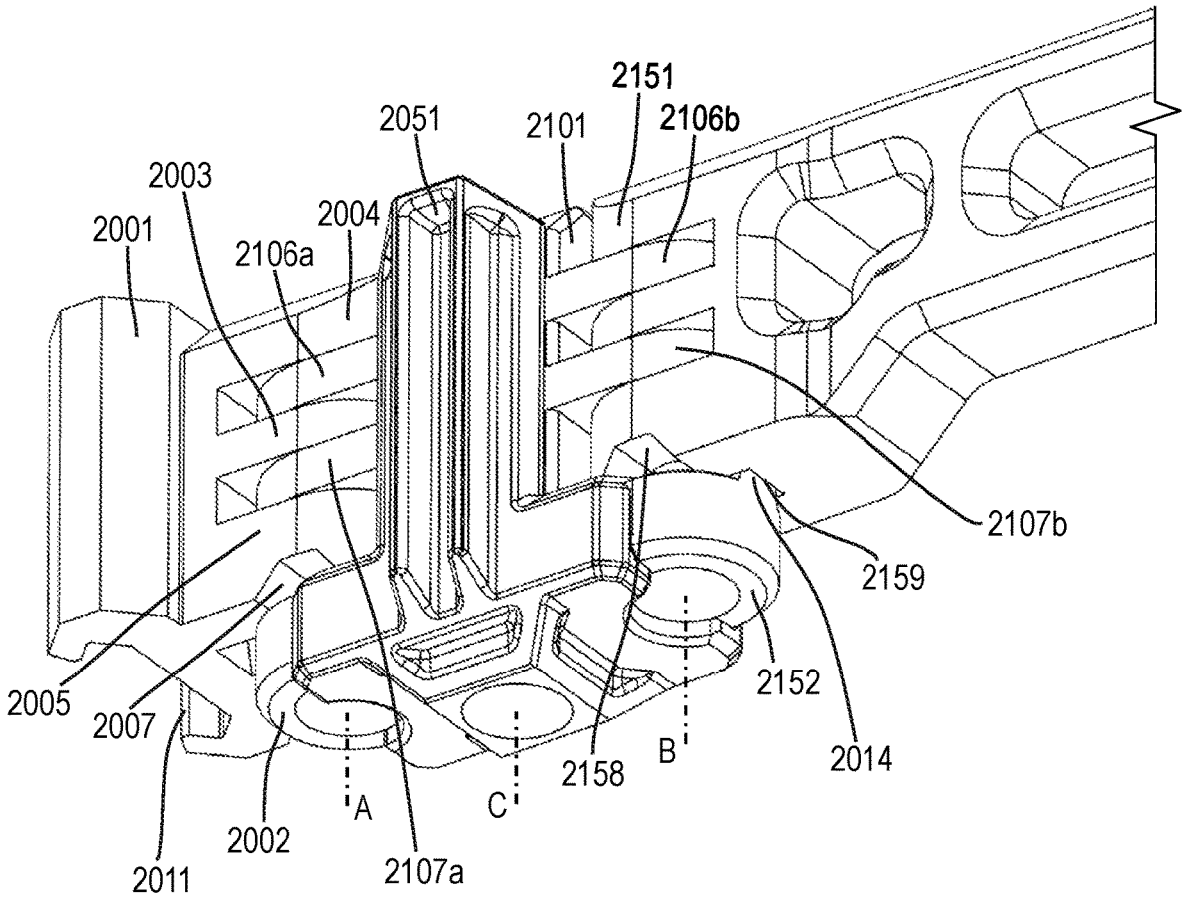
FIG. 17C is a left rear bottom partial perspective view of the folding stock assembly of FIG. 17A.

Based on the interactions described above between the actuation portion 2051 and the latch portions 2002, 2152, downward movement of the actuation portion 2051 can disengage mechanical connections within the folding stock assembly 2000 to allow rotation about axis A and/or axis B. In particular, downward movement of the actuation portion 2051 may cause forward latch portion 2002 to move protrusion 2014 out of a corresponding notch of the forward hinge fitting 2001. For example, as shown in FIG. 17A, when the folding stock assembly 2000 is in the rearward configuration, the protrusion 2014 of the forward latch portion 2002 engages forward notch 2009 of the forward hinge fitting 2001. Accordingly, downward movement of the forward latch portion 2002 disengages protrusion 2014 from forward notch 2009, which allows rotational movement about axis A. In addition, as shown in FIGS. 17B and 17C, when the folding stock assembly 2000 is in the rearward configuration, the protrusion 2014 of the rear latch portion 2152 engages rear notch 2159 of the rear hinge fitting 2151. Accordingly, downward movement of the rear latch portion 2152 disengages protrusion 2014 from rear notch 2159, which allows rotational movement about axis B. In some embodiments, in the rearward configuration, (i) the central protrusion 2015 of the forward latch portion 2002 engages at least one of the rear notch 2006 and the lower notch 2105 of the hinge body 2101 and (ii) the central protrusion 2015 of the rear latch portion 2152 engages at least one of the forward notch 2156 and the lower notch 2105 of the hinge body 2101.

When the folding stock assembly 2000 is in the left side folded configuration (similar to FIGS. 3A-3C), the protrusion 2014 of the forward latch portion 2002 engages the second lateral notch 2008 of the forward hinge fitting 2001 and the protrusion 2014 of the rear latch portion 2152 engages the first lateral notch 2157 of the rear hinge fitting 2151. In some embodiments, the central protrusion 2015 of the latch portion 2002 engages the first lateral notch 2007 and the central protrusion 2015 of the latch portion 2152 engages the second lateral notch 2158. The engagement between these protrusions (2014, 2015) and notches (2007, 2008, 2157, 2158) acts as both a fold lock to secure the stock 150 in the folded position and as a stop or limit to prevent the stock 150 from folding too far and contacting the firearm. Conventional firearms with folding stocks lack these two features.

When the folding stock assembly 2000 is in the right side folded configuration (similar to FIGS. 4A-4C), the protrusion 2014 of the forward latch portion 2002 engages the first lateral notch 2007 of the forward hinge fitting 2001 and the protrusion 2014 of the rear latch portion 2152 engages the second lateral notch 2158 of the rear hinge fitting 2151. In some embodiments, the central protrusion 2015 of the latch portion 2002 engages the second lateral notch 2008 and the central protrusion 2015 of the latch portion 2152 engages the first lateral notch 2157. The engagement between these protrusions (2014, 2015) and notches (2007, 2008, 2157, 2158) acts as both a fold lock to secure the stock 150 in the folded position and as a stop or limit to prevent the stock 150 from folding too far and contacting the firearm. Conventional firearms with folding stocks lack these two features.

In some embodiments, the advantage of having separate latch portions 2002, 2152 (and consequently separate protrusions 2014, 2015) determines that the folding stock assembly 2000 may engage or lock into a given position for each rotation axis A, B independent of one another. In other words, when moving the stock 150 between various different positions, the mechanism for one axis A, B may reach a desired position before the other axis and may be secured in a given configuration independent of the second axis.

The components of any of the firearm 1 and/or the folding stock assemblies 1000, 2000 described herein may be formed of materials including, but not limited to, thermoplastic, carbon composite, plastic, nylon, steel, aluminum, stainless steel, tool steel, high strength aluminum alloy, other plastic or polymer materials, other metallic materials, other composite materials, or other similar materials. Moreover, the components may be attached to one another via suitable fasteners, which include, but are not limited to, screws, bolts, rivets, welds, over molding, injection molding, epoxy, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An ambidextrous folding stock assembly for a firearm comprising:

a forward hinge fitting attached to a firearm;

a central assembly disposed on a rear side of the forward hinge fitting;

a rear hinge fitting disposed on a rear side of the central assembly; and a forward hinge axis extending through the forward hinge fitting and the central assembly such that the forward hinge fitting and the central assembly can rotate relative to one another, wherein:

the forward hinge axis is laterally aligned with a center of the firearm such that the forward hinge axis is equidistant between a left side of the firearm and a right side of the firearm;

the central assembly comprises:

at least one hinge body;

an actuation portion comprising a lower portion disposed below the at least one hinge body; and at least one latch portion disposed below the at least one hinge body.

2. The ambidextrous folding stock assembly of claim 1, further comprising a stock extending from the rear hinge fitting, wherein:

the rear hinge fitting and the stock are configured to pivot relative to the central assembly.

3. The ambidextrous folding stock assembly of claim 2, further comprising:

a rearward configuration wherein the stock extends rearward from the firearm;

a left side folded configuration wherein the stock is folded adjacent to the left side of the firearm; and a right side folded configuration wherein the stock is folded adjacent to the right side of the firearm.

4. The ambidextrous folding stock assembly of claim 1, further comprising:

a rear hinge axis extending through the rear hinge fitting and the central assembly, wherein;

the forward hinge axis has a vertical axial direction; and the rear hinge axis has a vertical axial direction.

5. The ambidextrous folding stock assembly of claim 1, further comprising at least one spring for biasing the actuation portion in a vertical direction relative to the at least one hinge body.

6. The ambidextrous folding stock assembly of claim 1, wherein the at least one latch portion comprises at least one protrusion that engages a portion of the folding stock assembly to prevent movement of the folding stock assembly.

7. The ambidextrous folding stock assembly of claim 6, wherein the at least one protrusion extends upward from the at least one latch portion.

8. The ambidextrous folding stock assembly of claim 6, wherein:

the at least one latch portion comprises a forward latch portion and a rear latch portion;

the forward latch portion comprises a protrusion that engages a notch of the forward hinge fitting; and the rear latch portion comprises a protrusion that engages a notch of the rear hinge fitting.

9. The ambidextrous folding stock assembly of claim 1, wherein:

the forward hinge fitting comprises a plurality of notches for engaging the at least one latch portion in various configurations; and the rear hinge fitting comprises a plurality of notches for engaging the at least one latch portion in various configurations.

10. An ambidextrous folding stock assembly for a firearm comprising:

a forward hinge fitting configured to attach to a firearm receiver;

a hinge body pivotably attached to a rear side of the forward hinge fitting;

a rear hinge fitting attached to a rear side of the hinge body;

an actuation portion movable relative to the hinge body;

at least one latch portion; and a forward hinge axis extending through the forward hinge fitting and the hinge body, wherein:

the hinge body comprises:

a first configuration where the hinge body is folded about the forward hinge axis relative to the forward hinge fitting toward a left side of the firearm receiver; and a second configuration where the hinge body is folded about the forward hinge axis relative to the forward hinge fitting toward a right side of the firearm receiver.

11. The ambidextrous folding stock assembly of claim 10, wherein the actuation portion is movable in a vertical direction relative to the hinge body.

12. The ambidextrous folding stock assembly of claim 10, wherein the actuation portion comprises:

at least one side member that interfaces with the hinge body; and a lower portion disposed below the hinge body.

13. The ambidextrous folding stock assembly of claim 10, further comprising a stock extending from the rear hinge fitting, wherein:

the central assembly is configured to pivot relative to the forward hinge fitting; and the rear hinge fitting and the stock are configured to pivot relative to the central assembly.

14. The ambidextrous folding stock assembly of claim 13, further comprising:

a rearward configuration wherein the stock extends rearward from the firearm receiver;

a left side folded configuration wherein the stock is folded adjacent to the left side of the firearm receiver; and a right side folded configuration wherein the stock is folded adjacent to the right side of the firearm receiver.

15. The ambidextrous folding stock assembly of claim 10, wherein the at least one latch portion comprises at least one protrusion that engages a portion of the folding stock assembly to prevent movement of the folding stock assembly.

16. The ambidextrous folding stock assembly of claim 15, wherein the at least one protrusion extends upward from the at least one latch portion.

17. The ambidextrous folding stock assembly of claim 15, wherein:

the at least one latch portion comprises a forward latch portion and a rear latch portion;

the forward latch portion comprises a protrusion that engages a notch of the forward hinge fitting; and the rear latch portion comprises a protrusion that engages a notch of the rear hinge fitting.

18. The ambidextrous folding stock assembly of claim 10, wherein:

the forward hinge fitting comprises a plurality of notches for engaging the at least one latch portion in various configurations; and the rear hinge fitting comprises a plurality of notches for engaging the at least one latch portion in various configurations.

19. An ambidextrous folding stock assembly for a firearm comprising:

a forward hinge fitting attached to a firearm;

a central assembly disposed on a rear side of the forward hinge fitting;

a rear hinge fitting disposed on a rear side of the central assembly;

a forward hinge axis extending through the forward hinge fitting and the central assembly such that the forward hinge fitting and the central assembly can rotate relative to one another; and a rear hinge axis extending through the central assembly and the rear hinge fitting such that the central assembly and the rear hinge fitting can rotate relative to one another, wherein:

the ambidextrous folding stock assembly is configured to simultaneously (i) pivot about the forward hinge axis and (ii) pivot about the rear hinge axis;

the central assembly comprises:

at least one hinge body;

an actuation portion comprising a lower portion disposed below the at least one hinge body; and at least one latch portion disposed below the at least one hinge body.

20. The ambidextrous folding stock assembly of claim 19, wherein rotation about the forward hinge axis and the rear hinge axis occurs in the same direction such that (i) counterclockwise rotation when viewed from above causes a stock attached to the rear hinge fitting to rotate to a right side of the firearm and (ii) clockwise rotation when viewed from above causes a stock attached to the rear hinge fitting to rotate to a left side of the firearm.

21. The ambidextrous folding stock assembly of claim 19, wherein rotation about the forward hinge axis and the rear hinge axis occurs in opposite directions such that a stock attached to the rear hinge fitting extends rearward but is offset laterally from a centerline of the firearm.

* * * * *